US008882455B2

(12) United States Patent
Takemoto

(10) Patent No.: US 8,882,455 B2
(45) Date of Patent: Nov. 11, 2014

(54) AXIAL FAN AND SLIDE MOLD

(75) Inventor: Shinji Takemoto, Kyoto (JP)

(73) Assignee: Nidec Corporation, Kyoto (JP)

( * ) Notice: Subject to any disclaimer, the term of this patent is extended or adjusted under 35 U.S.C. 154(b) by 612 days.

(21) Appl. No.: 13/191,519

(22) Filed: Jul. 27, 2011

(65) Prior Publication Data

US 2012/0027577 A1 Feb. 2, 2012

(30) Foreign Application Priority Data

Jul. 30, 2010 (JP) ..... 2010-171406

(51) Int. Cl.
*F04D 29/52* (2006.01)
*F04D 25/06* (2006.01)
*F04D 29/64* (2006.01)

(52) U.S. Cl.
CPC ..... *F04D 25/0613* (2013.01); *F04D 29/522* (2013.01); *F04D 29/646* (2013.01)
USPC ..... 415/186

(58) Field of Classification Search
USPC ..... 361/695; 415/182.1, 185, 186, 213.1, 415/214.1, 195, 201, 208.2, 208.3
See application file for complete search history.

(56) References Cited

U.S. PATENT DOCUMENTS 5,288,203 A * 2/1994 Thomas ..... 165/80.3
5,292,088 A * 3/1994 Lemont ..... 244/65
5,393,197 A * 2/1995 Lemont et al. ..... 415/68
5,707,205 A * 1/1998 Otsuka ..... 415/119
5,810,554 A * 9/1998 Yokozawa et al. ..... 415/176
5,975,194 A * 11/1999 Wagner ..... 165/80.3
6,132,171 A * 10/2000 Fujinaka et al. ..... 415/208.5
6,152,214 A * 11/2000 Wagner ..... 165/121
6,157,104 A * 12/2000 Yokozawa et al. ..... 310/58
6,179,562 B1 * 1/2001 Fujinaka ..... 415/208.5
6,183,196 B1 * 2/2001 Fujinaka ..... 415/208.5
6,254,342 B1 * 7/2001 Fujinaka et al. ..... 415/208.5
6,293,753 B1 * 9/2001 Pal et al. ..... 415/221
6,332,755 B1 * 12/2001 Fujinaka et al. ..... 415/208.5

(Continued)

FOREIGN PATENT DOCUMENTS

JP 11-093896 A 4/1999
JP 3101363 U 6/2004
WO 2009/057063 A2 5/2009

OTHER PUBLICATIONS

Takemoto et al., "Axial Fan and Electronic Device Including the Same", U.S. Appl. No. 13/185,523, filed Jul. 19, 2011.

*Primary Examiner* — Edward Look
*Assistant Examiner* — Eldon Brockman
(74) *Attorney, Agent, or Firm* — Keating & Bennett, LLP

(57) ABSTRACT

An axial fan includes an impeller and a housing including a side wall surrounding an outer circumference of the impeller. The side wall preferably includes at least one flat surface portion defined in an outer circumferential surface thereof, and a slit group including slits arranged to be spaced apart in a circumferential direction of an inner circumferential surface and extending in the same direction perpendicular or substantially perpendicular to the flat surface portion from the inner circumferential surface to the outer circumferential surface thereof. Within the slit group, a total number of slits positioned forward, with respect to a rotation direction of the impeller, of a point of contact of the inner circumferential surface with a tangent to the inner circumferential surface which is perpendicular or substantially perpendicular to a through direction of each slit is greater than a total number of slits positioned rearward of the contact point.

16 Claims, 16 Drawing Sheets

(56) References Cited

U.S. PATENT DOCUMENTS

| | | | | |
|---|---|---|---|---|
| 6,406,258 | B1 * | 6/2002 | Lin et al. | 415/213.1 |
| 6,505,680 | B1 * | 1/2003 | Hegde | 165/80.3 |
| 6,664,673 | B2 * | 12/2003 | Lopatinsky et al. | 310/63 |
| 6,710,486 | B1 * | 3/2004 | Horng et al. | 310/89 |
| 6,796,768 | B2 * | 9/2004 | Fujinaka et al. | 415/208.5 |
| 7,063,504 | B2 * | 6/2006 | Huang et al. | 415/165 |
| 7,080,970 | B2 * | 7/2006 | Horng et al. | 415/213.1 |
| 7,120,020 | B2 * | 10/2006 | Carter et al. | 361/697 |
| 7,164,582 | B2 * | 1/2007 | Hegde | 361/697 |
| 7,198,464 | B2 * | 4/2007 | Kuo | 415/213.1 |
| 7,223,068 | B2 * | 5/2007 | Horng et al. | 415/187 |
| 7,802,965 | B2 * | 9/2010 | Huang et al. | 415/165 |
| 7,911,790 | B2 * | 3/2011 | Carter et al. | 361/697 |
| 8,061,142 | B2 * | 11/2011 | Kastrup et al. | 60/748 |
| 8,068,339 | B2 * | 11/2011 | Kayama et al. | 361/695 |
| 2002/0028137 | A1 | 3/2002 | Fujinaka et al. | |
| 2003/0202879 | A1 * | 10/2003 | Huang et al. | 415/220 |
| 2005/0265828 | A1 * | 12/2005 | Horng et al. | 415/187 |
| 2005/0281665 | A1 * | 12/2005 | Horng et al. | 415/60 |
| 2008/0225480 | A1 * | 9/2008 | Kayama et al. | 361/695 |
| 2008/0259564 | A1 * | 10/2008 | Kayama et al. | 361/695 |
| 2010/0209264 | A1 * | 8/2010 | Takemoto et al. | 417/366 |
| 2011/0305565 | A1 * | 12/2011 | Kayama et al. | 415/208.2 |

* cited by examiner

AXIAL FAN AND SLIDE MOLD

BACKGROUND OF THE INVENTION

1. Field of the Invention

The present invention relates to an axial fan and a slide mold used in manufacturing an axial fan.

2. Description of the Related Art

Axial fans with housings that include slits have been known. For example, WO 2009/057063 discloses one such axial fan. This axial fan includes an impeller in which a plurality of blades is arranged in a circumferential direction about a central axis, and a housing arranged radially outward from the impeller to circumferentially surround the impeller. The housing includes a plurality of slits that are arranged in the circumferential direction and arranged to extend through the housing from an inner circumferential surface to an outer circumferential surface thereof.

However, there is sufficient room for improvement in efficiency of air intake through the slits of the related-art axial fan described above. This point will now be described below with reference to FIG. 16.

An axial fan illustrated in FIG. 16 includes a housing 1 whose external shape is substantially square. Each side of the housing 1 includes a slit group 4 made up of a plurality of slits 4*a* to 4*k* defined therein. Each of the slits 4*a* to 4*k* in each slit group 4 is arranged to extend through the corresponding side of the housing 1 from an inner circumferential surface 2 to an outer circumferential surface 3 of the housing 1. The slits 4*a* to 4*k* in each slit group 4 are arranged to extend in parallel or substantially in parallel with one another, and in a direction perpendicular to the corresponding radially outer side of the housing 1. With this arrangement of the slits, each slit group 4 inevitably includes a region (i.e., a region P shown in FIG. 16) where a direction (hereinafter referred to as an "air intake direction") W of air intake through the slits differs considerably from a rotation direction R of an impeller (not shown). Note here that the impeller draws in air in a direction along the rotation direction R of the impeller. In the regions P mentioned above, the air intake direction W differs considerably from the direction in which the impeller draws in air. Therefore, in the regions P, air that has come in through the slits tends to be less easily drawn in by the impeller. Therefore, the regions P cause reductions of air intake efficiency of the fan as a whole.

SUMMARY OF THE INVENTION

An axial fan according to a preferred embodiment of the present invention preferably includes an impeller arranged to rotate about a central axis and including a plurality of blades centered on the central axis, the blades being arranged to project radially outward and arranged in a circumferential direction; a housing including a side wall arranged to surround an outer circumference of the impeller; and a substantially square or substantially rectangular flange arranged on an end of the side wall on an inlet side or an outlet side. The side wall includes a slit group including a plurality of slits spaced apart from each other in a circumferential direction of an inner circumferential surface of the side wall, and arranged to extend in the same direction perpendicular or substantially perpendicular to one side of the flange through the side wall from the inner circumferential surface to an outer circumferential surface thereof. The total number of slits within the slit group that are positioned forward, with respect to a rotation direction of the impeller, of a point of contact of the inner circumferential surface with a tangent to the inner circumferential surface which is perpendicular or substantially perpendicular to a through direction of the slits is greater than the total number of slits that are positioned rearward of the contact point with respect to the rotation direction of the impeller.

An axial fan according to another preferred embodiment of the present invention preferably includes an impeller arranged to rotate about a central axis and including a plurality of blades centered on the central axis, the blades being arranged to project radially outward and arranged in a circumferential direction; and a housing including a side wall arranged to surround an outer circumference of the impeller, the side wall including at least one flat surface portion defined in an outer circumferential surface thereof. The side wall includes a slit group including a plurality of slits spaced apart from each other in a circumferential direction of an inner circumferential surface of the side wall, and arranged to extend in the same direction perpendicular or substantially perpendicular to the flat surface portion through the side wall from the inner circumferential surface to the outer circumferential surface thereof. The total number of slits within the slit group that are positioned forward, with respect to a rotation direction of the impeller, of a point of contact of the inner circumferential surface with a tangent to the inner circumferential surface which is perpendicular or substantially perpendicular to a through direction of the slits is greater than the total number of slits that are positioned rearward of the contact point with respect to the rotation direction of the impeller.

An axial fan according to yet another preferred embodiment of the present invention preferably includes an impeller arranged to rotate about a central axis including a plurality of blades centered on the central axis, arranged to project radially outward, and arranged in a circumferential direction; and a housing including a side wall arranged to surround an outer circumference of the impeller. The side wall includes a slit group including a plurality of slits spaced apart from each other in a circumferential direction of an inner circumferential surface of the side wall, and arranged to extend in the same direction through the side wall from the inner circumferential surface to an outer circumferential surface thereof. At least one of the plurality of slits in the slit group includes a tapered wind guide portion defined in an end portion thereof on a side closer to the central axis, the tapered wind guide portion being arranged to shift a direction in which air is taken in through the slit from a radial through direction of the slit to a direction that approaches a rotation direction of the impeller.

An axial fan according to yet another preferred embodiment of the present invention preferably includes an impeller arranged to rotate about a central axis and including a plurality of blades centered on the central axis, the blades being arranged to project radially outward and arranged in a circumferential direction; and a housing including a side wall arranged to surround an outer circumference of the impeller, the side wall including at least one flat surface portion defined in an outer circumferential surface thereof. The side wall includes a slit group including a plurality of slits spaced apart from each other in a circumferential direction of an inner circumferential surface of the side wall, and arranged to extend through the side wall from the inner circumferential surface to the flat surface portion thereof. The plurality of slits in the slit group have two or more different through directions.

Accordingly, axial fans according to various preferred embodiments of the present invention achieve an improvement in air intake efficiency when compared to known axial fans.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described in detail with reference to the accompanying drawings. Note that the present invention is not limited to the specific preferred embodiments described below. Also note that variations and modifications can be made appropriately as long as desired effects of the present invention are not substantially impaired. Also note that the preferred embodiments described below may be combined with other preferred embodiments without departing from the present invention. For the sake of convenience, it is assumed in the following description of the preferred embodiments of the present invention that a vertical direction of each figure is referred to as a "vertical direction". Note, however, that this assumption should not be construed to restrict an orientation of any device or member in actual use. Also note that, for the sake of convenience in description, a direction parallel or substantially parallel to a central axis J1 will be referred to as an axial direction, and a direction extending perpendicularly or substantially perpendicularly from the central axis J1 will be referred to as a radial direction.

First Preferred Embodiment

A first preferred embodiment of the present invention will now be described below with reference to FIGS. 1-6. An axial fan A according to the present preferred embodiment can be used, for example, to cool an electronic device by discharging a high-temperature air out from an inside of a case of the electronic device to an outside thereof.

Overall Structure

Figure 1:
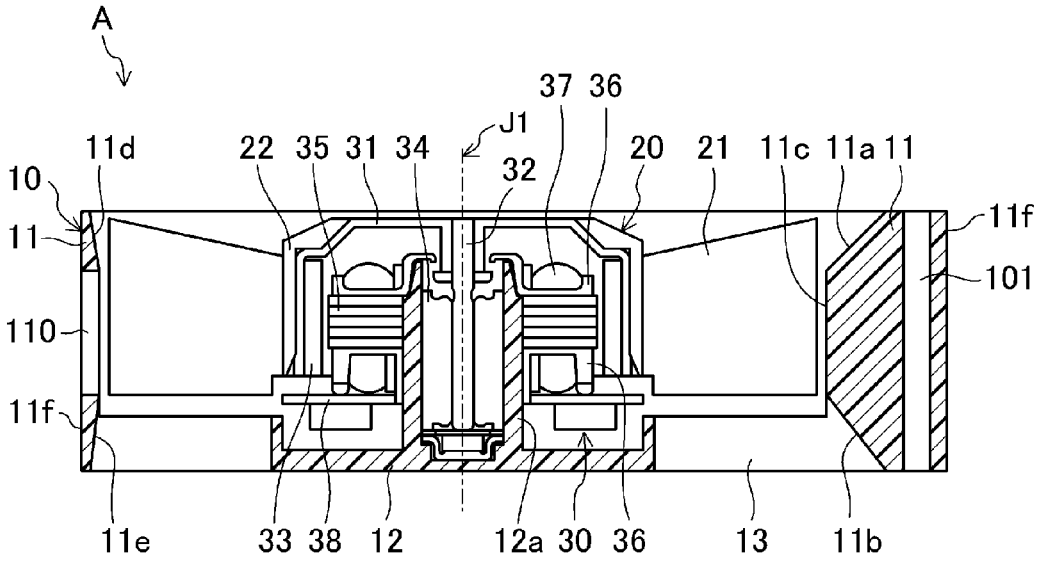
FIG. 1 is a cross-sectional view of an axial fan according to a first preferred embodiment of the present invention.
Figure 2:
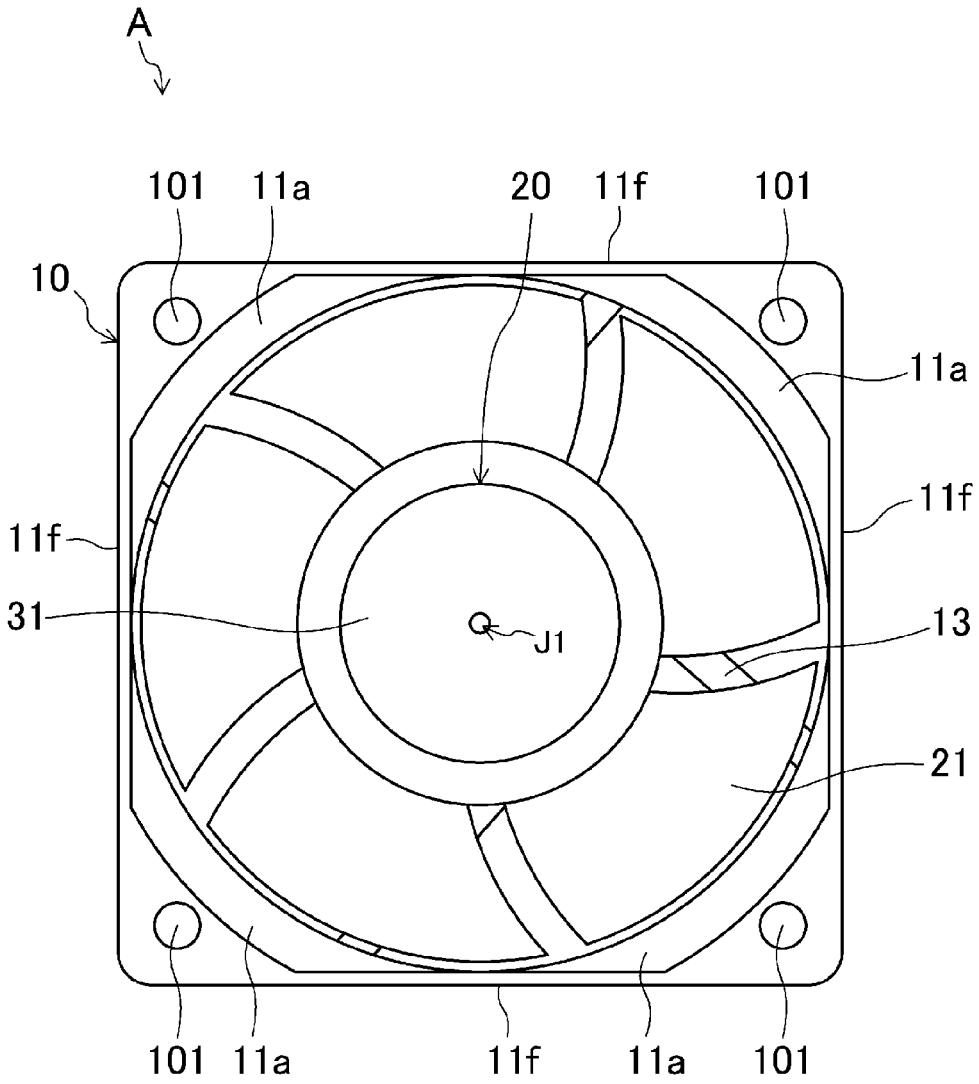
FIG. 2 is a plan view of the axial fan illustrated in FIG. 1 when viewed from above in a direction parallel to a central axis J1.

An overall structure of the axial fan A will now be described below. Referring to FIGS. 1 and 2, the axial fan A includes a housing 10, an impeller 20, and a motor portion 30.

The motor portion 30 preferably includes a rotor yoke 31, which is substantially in the shape of a covered cylinder. The impeller 20 is attached to an outside surface of the rotor yoke 31. One end portion of a shaft 32 is joined and fixed to the rotor yoke 31. The rotor yoke 31 is arranged to rotate together with the shaft 32 about a center thereof. A rotation axis of the shaft 32 will be referred to as the central axis J1.

The impeller 20 preferably includes a substantially cylindrical impeller cup portion 22 and a plurality of blades 21. The blades 21 are arranged to rotate about the central axis J1 to produce an air flow. Referring to FIG. 2, the blades 21 are arranged on an outside surface of the impeller cup portion 22 such that the blades 21 are preferably arranged at regular intervals in a circumferential direction about the central axis J1. The blades 21 are arranged to rotate in accordance with rotation of the impeller 20. Rotation of the blades 21 causes an air to be pushed downward (i.e., in a downward direction in FIG. 1). The downward push of the air causes an air flow traveling in a direction parallel or substantially parallel to the central axis J1.

The housing 10 preferably includes a side wall 11, a base portion 12, and support ribs 13. An inner circumferential surface of the side wall 11 is preferably substantially cylindrical, while an external shape of the side wall 11 is preferably substantially square. A radially outer periphery of the impeller 20 is arranged radially opposite the inner circumferential surface of the side wall 11. That is, the side wall 11 is arranged to define an air channel for the air flow which is produced when the impeller 20 is rotated about the central axis J1. A radial gap is arranged between the blades 21 and the side wall 11 to prevent the blades 21 from coming into contact with the side wall 11. A fitting hole 101 is defined in each of four corners of the side wall 11. The fitting holes 101 are used to attach the axial fan A to, for example, the electronic device or the like. The fitting holes 101 are arranged to extend through the four corners of the side wall 11 in the direction parallel or substantially parallel to the central axis J1. Note that the fitting holes 101 may be defined in other locations than the four corners of the side wall 11 instead. Illustration of modifications of the fitting holes 101 is omitted.

Referring to FIG. 1, the side wall 11 includes an upper opening portion at its upper end (e.g., on an inlet side), and a lower opening portion at its lower end (e.g., on an outlet side). The upper opening portion of the side wall 11 preferably includes inclined surfaces 11*a* and 11*d* defined therein. The inclined surfaces 11*a* and 11*d* are arranged to gradually increase a cross section of the air channel which is perpendicular or substantially perpendicular to the central axis J1 with a decreasing distance from the upper end of the side wall 11. In other words, the inclined surfaces 11*a* and 11*d* are arranged to be at increasingly greater distances from the central axis J1 with increasing height in the direction parallel to the central axis J1. In particular, each of the inclined surfaces 11*a* is defined by a portion of a conical surface centered on the central axis J1.

The lower opening portion of the side wall 11 preferably includes inclined surfaces 11*b* and 11*e* defined therein. The inclined surfaces 11*b* and 11*e* are arranged to gradually expand the cross section of the air channel which is perpendicular or substantially perpendicular to the central axis J1 with decreasing distance from the lower end of the side wall 11. In other words, the inclined surfaces 11*b* and 11*e* are arranged to be at increasingly greater distances from the central axis J1 with decreasing height in the direction parallel to the central axis J1. In particular, each of the inclined surfaces 11*b* is defined by a portion of a conical surface centered on the central axis J1.

Note that each of the inclined surfaces 11*a* and 11*b* may not necessarily be defined by a portion of the conical surface, but may be in any desirable shape as long as the inclined surfaces 11*a* and 11*b* are arranged to gradually expand the cross section of the air channel which is perpendicular to the central axis J1 with increasing or decreasing height in the direction parallel to the central axis J1.

According to the present preferred embodiment, the inclined surfaces 11*d* and 11*e* are preferably defined in other portions of the side wall 11 than the four corners thereof. An angle of inclination of each of the inclined surfaces 11*d* and 11*e* is small. Therefore, lack of the inclined surfaces 11*d* and 11*e* would not significantly affect an air volume characteristic of the axial fan A. Therefore, the inclined surfaces 11*d* and 11*e* may not necessarily be provided in other preferred embodiments of the present invention.

A straight surface 11*c* is preferably defined between the inclined surfaces 11*a* and 11*b* in the direction parallel or substantially parallel to the central axis J1. The radial distance between the central axis J1 and the inner circumferential surface of the side wall 11 is preferably substantially constant throughout an entire portion of the inner circumferential surface which corresponds to the straight surface 11*c*. The side wall 11 is preferably defined through injection molding. The straight surface 11*c* is preferably inclined at a slight angle to the central axis J1 such that the straight surface 11*c* will become more distant from the central axis J1 with increasing height in the axial direction. This slight angle is referred to as a draft angle, and is set in order to facilitate mold release when a molded article is removed from molds. The draft angle has a negligible effect on the air volume characteristic of the axial fan A.

The base portion 12 is arranged radially inward of the side wall 11 to support the motor portion 30 by being fixed together therewith. In more detail, the base portion 12 is arranged at a level corresponding to that of a lower end portion of the side wall 11. The base portion 12 is arranged substantially in the shape of a cylinder having a bottom and centered on the central axis J1. A bearing housing 12*a* arranged substantially in the shape of a cylinder having a bottom and centered on the central axis J1 is arranged in a center of the base portion 12. A sleeve 34, which defines a portion of a bearing described below, is supported by an inside surface of the bearing housing 12*a*.

The support ribs 13, which are preferably four in number, for example, are arranged on an outside surface of the base portion 12 to project radially outward therefrom. In addition, the four support ribs 13 are arranged in a circumferential direction of the outside surface of the base portion 12, and centered on the central axis J1. Each of the support ribs 13 is joined and connected to the inner circumferential surface of the side wall 11. In more detail, the support ribs 13 are joined and connected to the inclined surfaces 11*b*, which define portions of the inner circumferential surface of the side wall 11. That is, the base portion 12 is supported by the side wall 11 through the four support ribs 13. The side wall 11, the base portion 12, and the support ribs 13 are defined continuously and integrally with one another through, for example, injection molding. A material used in this injection molding is, for example, a resin. Note, however, that application of the injection molding using the resin is not essential to the present invention and any other forming method or material could be used. For example, a die-casting process using an aluminum alloy may be applied to define the side wall 11, the base portion 12, and the support ribs 13 continuously and integrally with each other.

The sleeve 34 is preferably fixed inside the bearing housing 12*a*. The shaft 32 is inserted inside the sleeve 34 such that the shaft 32 is rotatably supported by the sleeve 34. The sleeve 34 and the shaft 32 together define the bearing. The sleeve 34 is a cylindrical member made of a porous material, such as a sintered material, for example, and impregnated with a lubricating oil. Because the sleeve 34 is impregnated with the lubricating oil, the lubricating oil will also be provided in a radial gap between the shaft 32 and an inner circumferential surface of the sleeve 34. That is, the shaft 32 is rotatably supported by the sleeve 34 through the lubricating oil. Note that use of the sleeve 34 (i.e., a plain bearing arranged to rotatably support the shaft 32 through the lubricating oil as described above) is not essential to the present invention, and that a rolling-element bearing or any other desirable type of bearing, such as, for example, a ball bearing, may be used instead in other preferred embodiments of the present invention. An appropriate bearing member may be chosen in view of required characteristics and costs of the axial fan A.

A substantially cylindrical rotor magnet 33 is preferably fixed to an inner circumferential surface of the rotor yoke 31. The rotor magnet 33 is magnetized such that a plurality of magnetic poles are arranged to alternate in polarity in the circumferential direction. A stator portion is arranged radially inward of the rotor magnet 33. The stator portion preferably includes a stator core 35, coils 37, an insulator 36, and a circuit board 38. The stator core 35 is supported on an outside surface of the bearing housing 12*a*. Copper wires are wound around the stator core 35, with the insulator 36 arranged between the copper wires and the stator core 35, to thereby define the coils 37. The circuit board 38 is arranged on a lower end of the stator core 35. The circuit board preferably includes a rotation control circuit arranged to control the rotation of the impeller 20.

Regarding the circuit board 38, electronic components and end portions of the copper wires leading from the coils 37 are mounted on a printed circuit board. Currents supplied from an external power supply are supplied to the coils 37 through the electronic components, such as, for example, an IC, a Hall element, etc., to suitably control generation of magnetic flux by the stator core 35. As a result, the magnetic flux generated by the stator core 35 interacts with magnetic flux generated by the rotor magnet 33 to produce a torque centered on the central axis J1, which works to cause the impeller 20 to rotate about the central axis J1.

Structure of Slits

Figure 3:
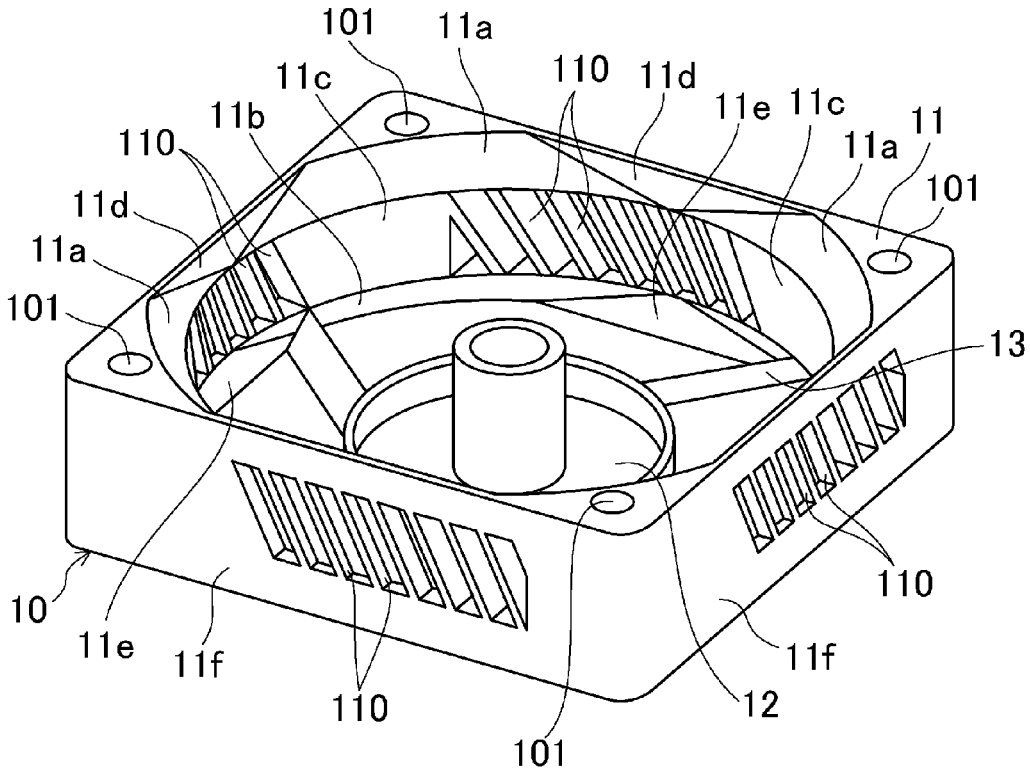
FIG. 3 is a perspective view illustrating a housing of the axial fan according to the first preferred embodiment of the present invention.

Next, slits 110*a* to 110*h* defined in the side wall 11 of the housing 10 will be described in detail below with reference to FIGS. 3 to 5. Note that, in FIGS. 3 and 5, the impeller 20, the motor portion 30, and so on are not shown for the sake of convenience.

The straight surface 11*c* of the side wall 11 includes the slits 110*a* to 110*h* defined therein. The slits 110*a* to 110*h* are arranged to extend from the straight surface 11*c* radially outward through the side wall 11. The external shape of the side wall 11 preferably is substantially square as described above. An outer circumferential surface 11*f* of the side wall 11 includes four flat surface portions (i.e., four sides). The slits 110*a* to 110*h* are arranged in the circumferential direction in the straight surface 11*c*, which defines the inner circumferential surface of the side wall 11. The slits 110*a* to 110*h* are arranged in each flat surface portion (i.e., each side) to extend in the same direction (i.e., in a through direction T shown in FIG. 5) perpendicular or substantially perpendicular to the corresponding flat surface portion (i.e., side) from the straight surface 11*c*, i.e., the inner circumferential surface, to the outer circumferential surface 11*f* of the side wall 11. In the present preferred embodiment, the slits 110*a* to 110*h* defined in each flat surface portion (each side) constitute a slit group 110. That is, the side wall 11 according to the present preferred embodiment includes four slit groups 110 each of which is arranged in a separate one of the flat surface portions (sides).

Figure 4:
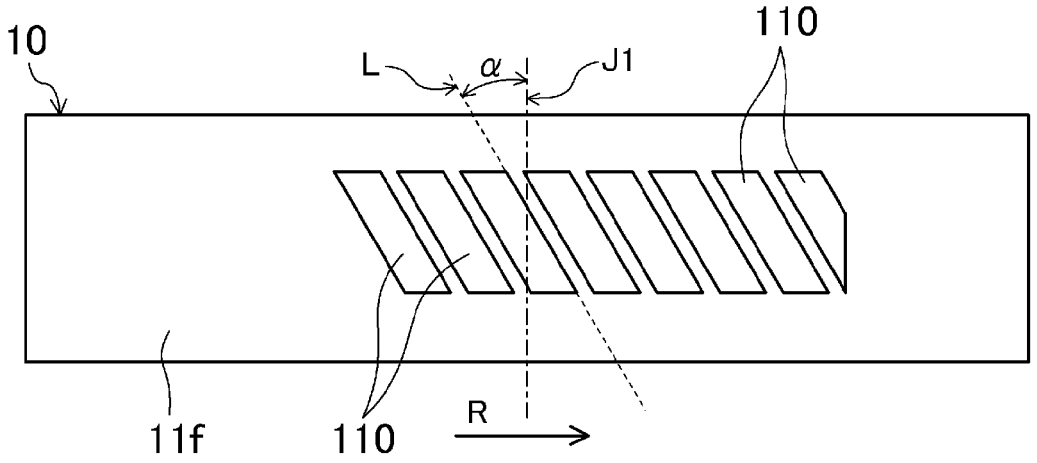
FIG. 4 is a plan view of the housing according to the first preferred embodiment of the present invention when viewed from a radial outside direction.

Referring to FIG. 4, the longitudinal direction L of each of the slits 110*a* to 110*h* in each slit group 110 is inclined at an angle $\alpha$ with respect to the central axis J1. The angle $\alpha$ is preferably in a range of 0 degrees to 90 degrees. In the present preferred embodiment, the slits 110*a* to 110*h* are arranged only within a region corresponding to the straight surface 11*c*. Note, however, that the slits 110*a* to 110*h* may be arranged to extend over the region corresponding to the straight surface 11*c* and any of the inclined surfaces 11*a*, 11*d*, 11*b*, and 11*e*, in other preferred embodiments of the present invention.

Figure 5:
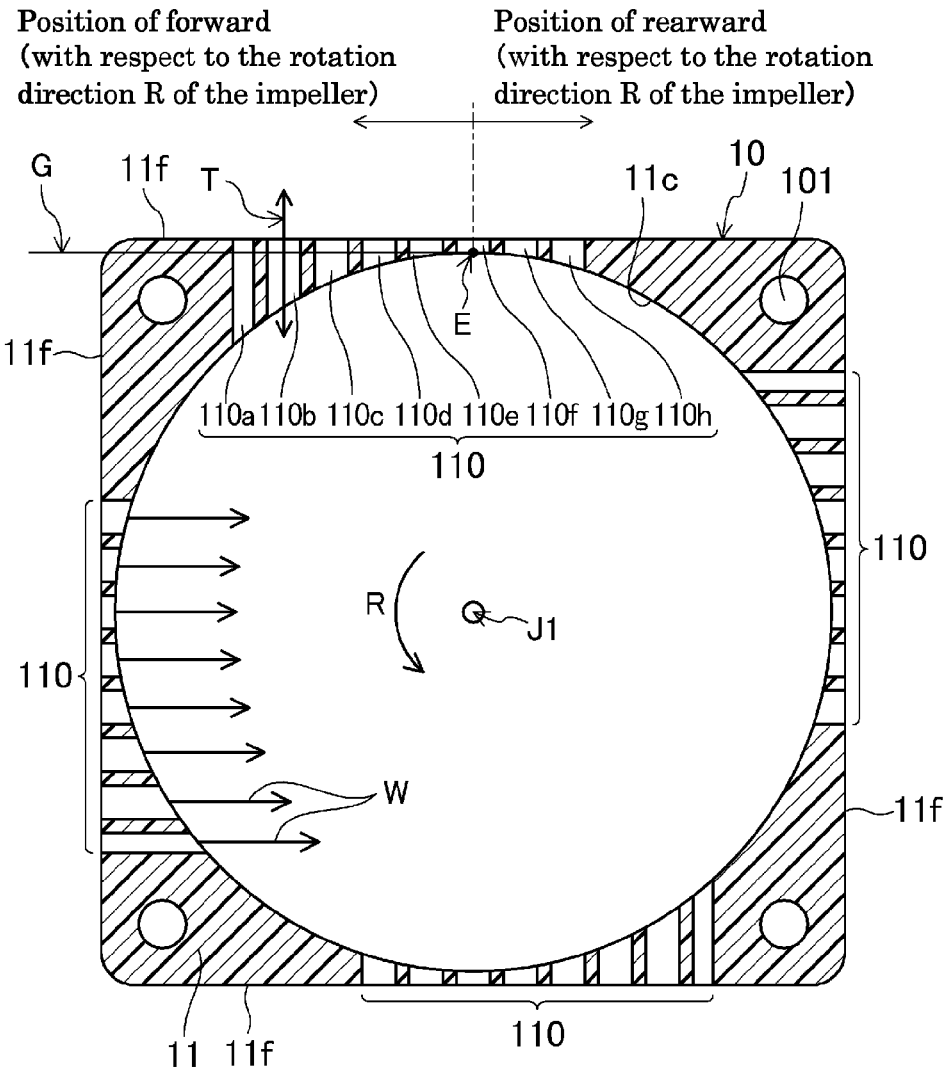
FIG. 5 is a cross-sectional view of the housing according to the first preferred embodiment of the present invention in a cross-section perpendicular to the central axis J1.

Referring to FIG. 5, in the present preferred embodiment, each of the slit groups 110 can be divided into subgroups of slits as described below. A first subgroup includes slits that are positioned forward (with respect to a rotation direction R of the impeller 20) of a point E of contact of the straight surface 11*c* with a tangent G to the straight surface 11*c* which is perpendicular to the through direction T of each of the slits 110*a* to 110*h*. A second subgroup includes slits that are positioned rearward (with respect to the rotation direction R of the impeller 20) of the point E of contact of the straight surface 11*c* with the tangent G. The number of slits positioned forward of the contact point E is greater than the number of slits positioned rearward of the contact point E. Specifically, in the present preferred embodiment, the number of slits positioned forward of the contact point E preferably is, for example, five (i.e., the slits 110*a* to 110*e*), while the number of slits positioned rearward of the contact point E preferably is, for example, two (i.e., the slits 110*g* and 110*h*). Note that the slit 110*f*, which is positioned at the contact point E, is not counted here.

As described above, the side wall 11, the base portion 12, and the support ribs 13 are preferably molded of a resin material through, for example, injection molding. In the present preferred embodiment, the inner circumferential surface of the side wall 11, the support ribs 13, and the base portion 12 are molded through an upper mold and a lower mold which are caused to slide in the direction parallel or substantially parallel to the central axis J1. Once the upper and lower molds are brought into contact with each other in the direction parallel or substantially parallel to the central axis J1, a closed space is defined between the upper and lower molds and slide molds 40, which will be described below. A molten resin is injected into the closed space that has a shape that corresponds to the shape of a combination of the side wall 11, the support ribs 13, and the base portion 12. After the molten resin becomes solidified within the closed space, the upper and lower molds are separated from each other. As a result, the side wall 11, the support ribs 13, and the base portion 12 are defined integrally with one another as a single monolithic member. As described above, the side wall 11, the support ribs 13, and the base portion 12 may be formed through other methods such as, for example, a die-casting process using an aluminum alloy.

Figure 6:
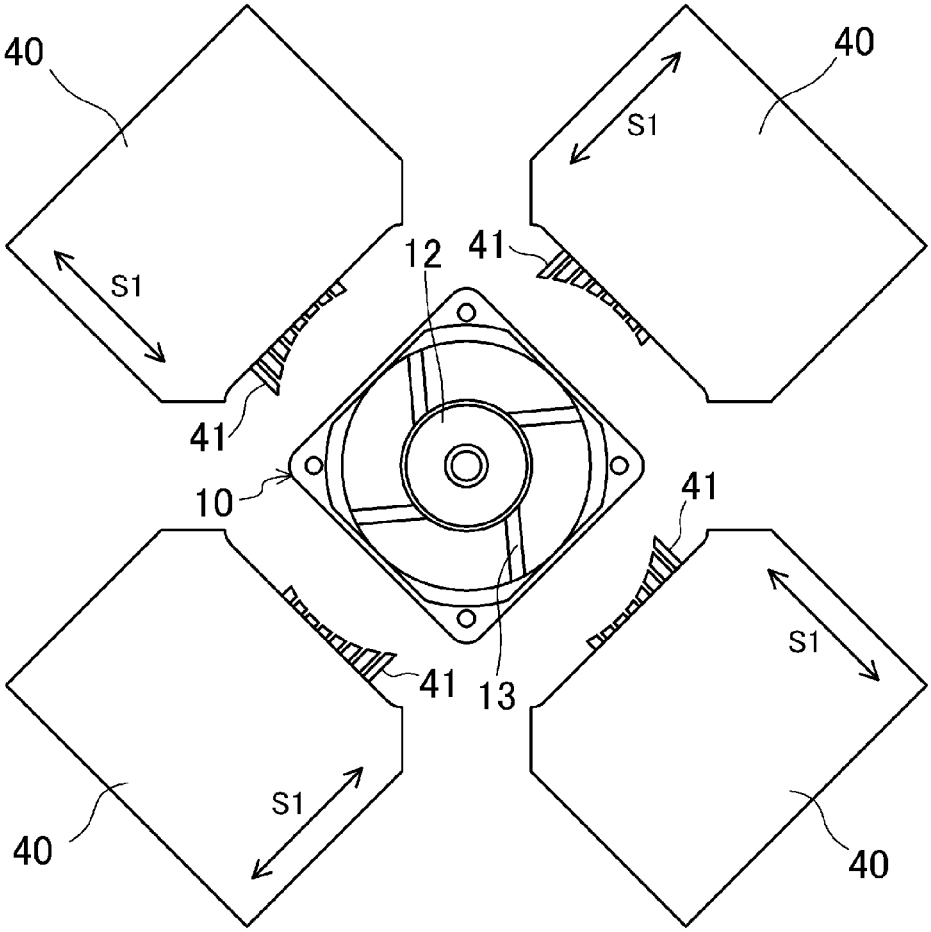
FIG. 6 is a plan view illustrating an example of slide molds that can be used to mold the housing according to the first preferred embodiment of the present invention.

Referring to FIG. 6, the slit groups 110 are defined through the slide molds 40, which are four in number, for example. Each of the four slide molds 40 is caused to slide in a direction (i.e., a slide direction S1) that is parallel or substantially parallel to a direction perpendicular to a separate one of the four flat surface portions (sides) of the side wall 11. Each slide mold 40 includes a plurality of slit defining portions 41 arranged to project radially inward. Each slide mold 40 is caused to slide in a direction perpendicular or substantially perpendicular to the central axis J1 in conjunction with the slide of the upper and lower molds. When the upper and lower molds are arranged in contact with each other in the direction parallel or substantially parallel to the central axis J1, the slide molds 40 are arranged to enclose a vicinity of a surface of contact between the upper and lower molds from radially outward. That is, the outer circumferential surface 11*f* of the side wall 11 is defined through the slide molds 40. The aforementioned slit defining portions 41 are arranged to extend into the closed space defined when the upper and lower molds and the slide molds 40 are arranged in contact with one another. The slit defining portions 41 are arranged to extend up to portions of the upper and lower molds which define the inner circumferential surface of the side wall 11. Once the molten resin is injected into the closed space defined by the molds, the resin gradually fills the closed space while leaving open portions occupied by the slit defining portions 41. That is, portions of the closed space which are occupied by the slit defining portions 41 correspond to the slits 110*a* to 110*h* of the side wall 11. When the upper and lower molds are separated away from each other in the direction parallel or substantially parallel to the central axis J1, each of the four slide molds 40 is caused to slide radially outward to be away from the upper and lower molds. The slits 110*a* to 110*h* are thus defined through the slide molds 40 in the above-described manner.

When the impeller 20 is caused to rotate about the central axis J1, air present on an upper side of the axial fan A in FIG. 1 is caused to flow downward in FIG. 1. At this time, the air staying on the upper side of the axial fan A is guided by the inner circumferential surface of the side wall 11 of the housing 10, more specifically, by the inclined surfaces 11*a* and 11*d*, to flow into a space inside the side wall 11. The cross section of the air channel inside the inner circumferential surface of the side wall 11, the cross section being perpendicular to the central axis J1, is smaller at levels at which the straight surface 11*c* is defined than at levels at which the inclined surfaces 11*a* are defined. Therefore, in accordance with Bernoulli's theorem, a flow of air passing through the straight surface 11*c* has a greater flow velocity than that of a flow of air passing through the inclined surfaces 11*a*. Because the flow of air passing through the straight surface 11*c* has a greater flow velocity than that of a flow of air in any other region, a negative pressure is generated relative to an atmospheric pressure in a region around the side wall 11. As a result, air is caused to pass through the slits 110*a* to 110*h* of each slit group 110 to flow into the space inside the inner circumferential surface of the side wall 11 to thereby contribute to an improvement in air volume of the axial fan A.

Moreover, according to the present preferred embodiment, the number of slits positioned forward of the contact point E with respect to the rotation direction R of the impeller 20 within each slit group 110 is arranged to be greater than the number of slits positioned rearward of the contact point E with respect to the rotation direction R of the impeller 20, as described above. That is, within each slit group 110, the total number of slits positioned rearward of the contact point E with respect to the rotation direction R of the impeller 20, an "air intake direction" W (that is, the through direction T of each of the slits 110*a* to 110*h*) of which tends to differ considerably from a direction in which the impeller 20 draws in air (in other words, the rotation direction R of the impeller 20), is reduced. In other words, within each slit group 110, the total number of slits whose air intake direction W is relatively close to the direction in which the impeller 20 draws in air is arranged to be relatively large. This contributes to avoiding a situation in which air that has come in through the slits 110*a* to 110*h* is hindered from being drawn in by the impeller 20, and thus results in an improved efficiency in air intake through the slits 110*a* to 110*h*. This leads to an improvement in the air volume characteristic of the axial fan A.

Moreover, a noise is generated when the air intake direction W of a slit differs considerably from the direction in which the impeller 20 draws in air. In the present preferred embodiment, however, because the number of slits whose air intake direction W differs considerably from the direction in which the impeller 20 draws in air is relatively reduced, a reduction in such a noise is achieved.

One example method of making the air intake direction W of a slit (i.e., the through direction T of the slit) closer to the direction in which the impeller 20 draws in air is to incline the through direction T of the slit with respect to a direction perpendicular or substantially perpendicular to the corresponding side of the side wall 11 (i.e., an inclined slit). When this method is used, however, slide molds (see FIG. 11) used to define the slits and the outer circumferential surface 11*f* of the side wall 11 are required to have relatively sharp shapes. When the slide molds have sharp shapes, the slide molds tend to be more easily damaged, leading to a shortened life of the slide molds. In the present preferred embodiment, however, the through direction T of each of the slits 110*a* to 110*h* is arranged to be perpendicular or substantially perpendicular to the corresponding side of the side wall 11, and therefore, as illustrated in FIG. 6, each of the slide molds 40 does not have a sharp shape on the whole. Thus, each of the slide molds 40 is prevented from having a shortened life.

Note that, in modifications of the present preferred embodiment, the number of slits 110*a* to 110*h* in each slit group 110 is not limited to the number described above. Also note that, in modifications of the present preferred embodiment, neither the total number of slits positioned forward of the contact point E nor the total number of slits positioned rearward of the contact point E in each slit group 110 is limited to the number described above, as long as the total number of slits positioned forward of the contact point E is arranged to be greater than the total number of slits positioned rearward of the contact point E.

In the present preferred embodiment, the external shape of the side wall 11 is substantially square (in other words, the outer circumferential surface 11*f* of the side wall 11 is shaped so as to include four flat surface portions). Note, however, that this is not essential to the present invention, and that the outer circumferential surface 11*f* of the side wall 11 may be arranged in any desirable shape, such as, for example, the shape of a barrel, including only two flat surface portions opposed to each other, in other preferred embodiments of the present invention. It is enough that the outer circumferential surface 11*f* of the side wall 11 should be shaped so as to include at least one flat surface portion.

Second Preferred Embodiment

Figure 7:
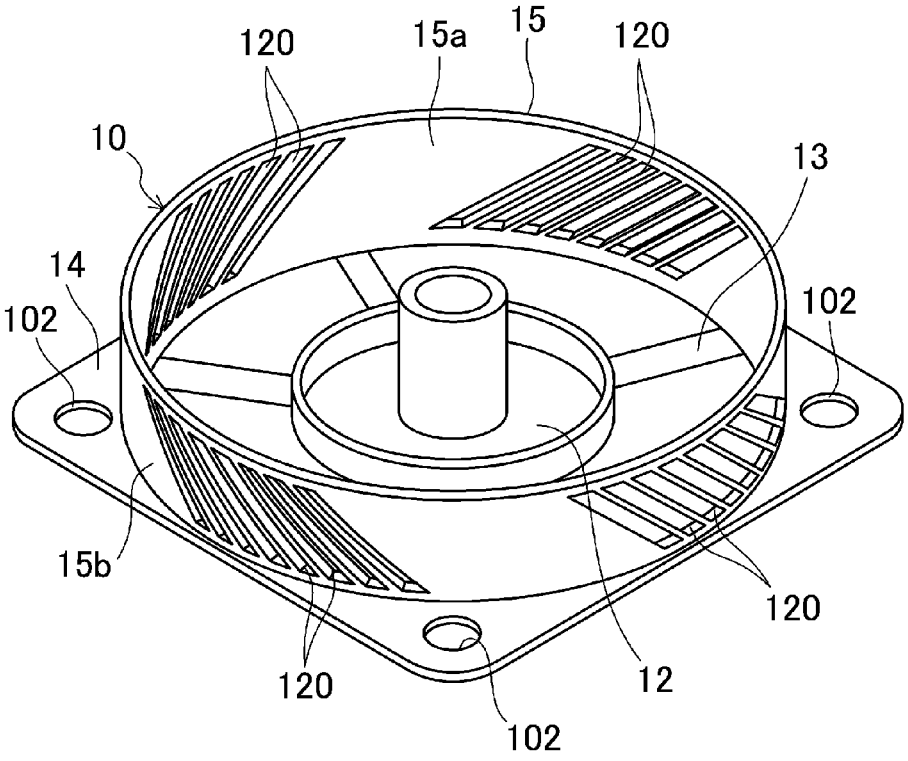
FIG. 7 is a perspective view illustrating a housing according to a second preferred embodiment of the present invention.

A second preferred embodiment of the present invention will now be described below with reference to FIGS. 7 and 8. An axial fan according to the present preferred embodiment is similar to the axial fan A according to the first preferred embodiment described above except in the structure of the side wall of the housing 10.

In contrast to the first preferred embodiment described above, a side wall 15 of the housing 10 according to the present preferred embodiment is arranged to be entirely cylindrical. The base portion 12 is arranged at a level corresponding to that of a lower end portion of the side wall 15, and, although not all of them are shown in the FIGS. 7 and 8, four support ribs 13 are arranged on an outside surface of the base portion 12 to project radially outward therefrom, as in the first preferred embodiment described above. In addition, a substantially square flange 14 is arranged on a lower end (i.e., on the outlet side) of the side wall 15. Fitting holes 102 are defined in four corners of the flange 14.

Four slit groups 120 are defined in the side wall 15. Each of the slit groups 120 is arranged to extend through the side wall 15 radially outward. Each slit group 120 includes a plurality of slits 120*a* to 120*h*. The slits 120*a* to 120*h* in each slit group 120 are arranged in a circumferential direction of an inner circumferential surface 15*a* of the side wall 15. The slits 120*a* to 120*h* in each slit group 120 are arranged to extend in the same direction (i.e., in a through direction T shown in FIG. 8) perpendicular or substantially perpendicular to a corresponding side of the flange 14 through the side wall 15 from the inner circumferential surface 15*a* to an outer circumferential surface 15*b* thereof. In the present preferred embodiment, each of the slit groups 120 is individually arranged to correspond to separate sides of the flange 14.

Figure 8:
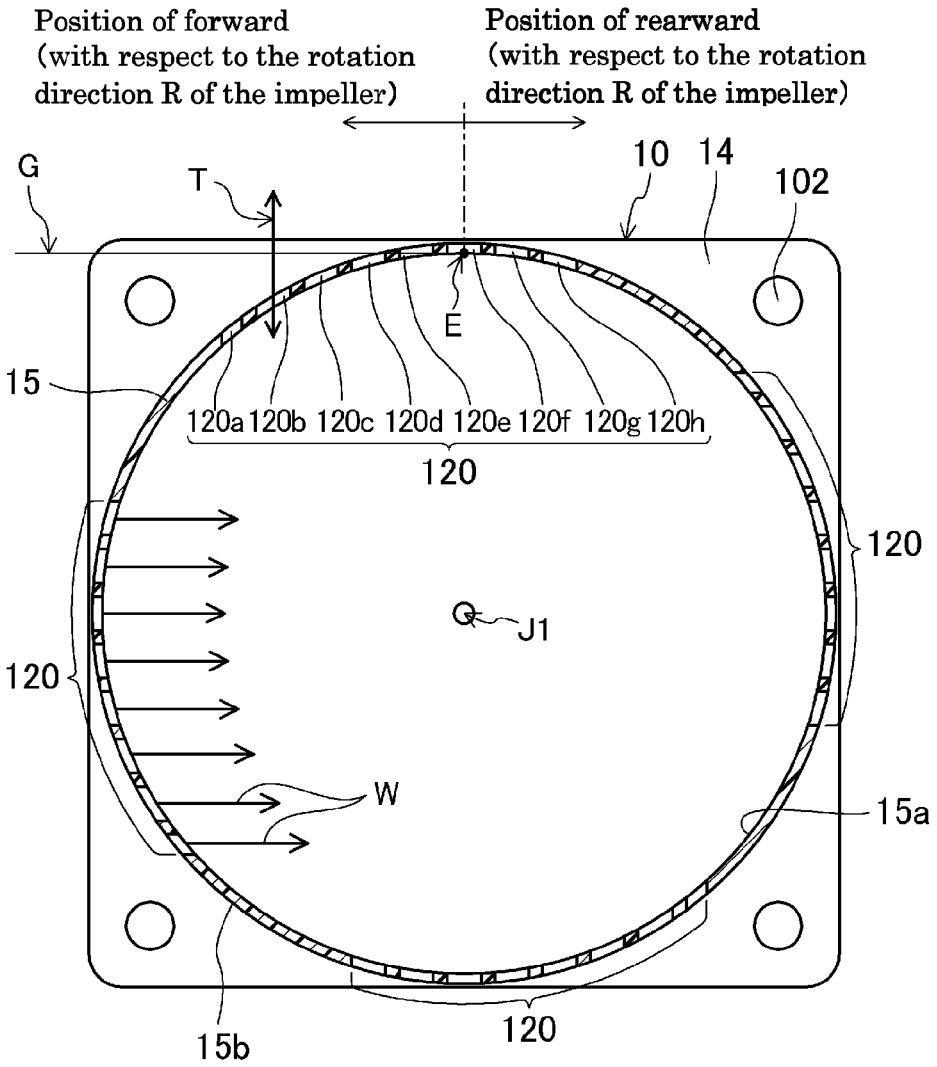
FIG. 8 is a cross-sectional view illustrating the housing according to the second preferred embodiment of the present invention in a cross-section perpendicular to the central axis J1.

Referring to FIG. 8, in the present preferred embodiment as well as in the first preferred embodiment described above, within each slit group 120, the total number of slits positioned forward (with respect to the rotation direction R of the impeller 20) of a point E of contact of the inner circumferential surface 15*a* with a tangent G to the inner circumferential surface 15*a* which is perpendicular to the through direction T of each of the slits 120*a* to 120*h* is arranged to be greater than the number of slits positioned rearward (with respect to the rotation direction R of the impeller 20) of the contact point E. Specifically, in the present preferred embodiment, the number of slits positioned forward of the contact point E is preferably five (that is, the slits 120*a* to 120*e*), while the total number of slits positioned rearward of the contact point E is preferably two (that is, the slits 120*g* and 120*h*). Note that the slit 120*f*, which is positioned directly at the contact point E is not counted. That is, within each slit group 120, the total number of slits positioned rearward of the contact point E with respect to the rotation direction R of the impeller 20, the air intake direction W (that is, the through direction T of each of the slits 120*a* to 120*h*) of which tends to considerably differ from the direction in which the impeller 20 draws in air (in other words, the rotation direction R of the impeller 20), is reduced. In other words, within each slit group 120, the number of slits whose air intake direction W is relatively close to the direction in which the impeller 20 draws in air is arranged to be relatively large. This contributes to avoiding a situation in which air that has come in through the slits 120*a* to 120*h* is hindered from being drawn in by the impeller 20. This results in an improved efficiency in air intake through the slits 120*a* to 120*h*, and also results in a reduction in noise. Other structural features, actions, and effects of the present preferred embodiment are similar to those of the first preferred embodiment described above.

Third Preferred Embodiment

Figure 9:
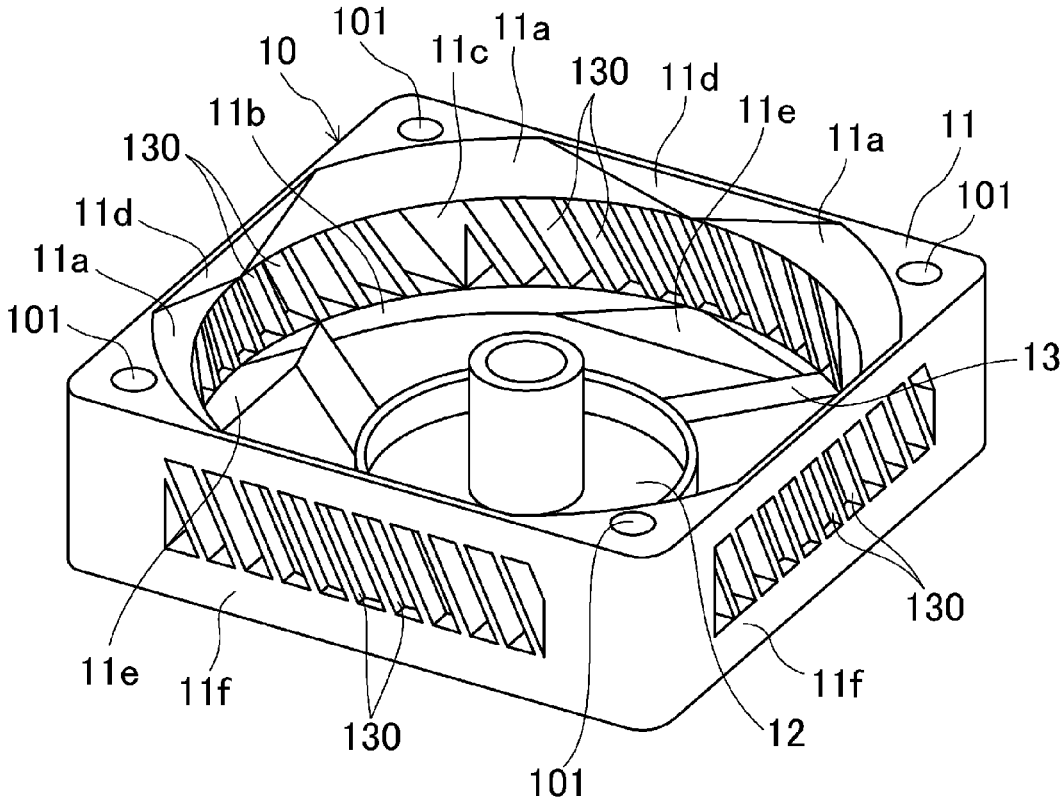
FIG. 9 is a perspective view illustrating a housing according to a third preferred embodiment of the present invention.

A third preferred embodiment of the present invention will now be described below with reference to FIGS. 9, 10, and 11. An axial fan according to the present preferred embodiment is similar to the axial fan A according to the first preferred embodiment described above except in the structure of slits.

As with the side wall 11 of the housing 10 according to the first preferred embodiment described above, the side wall 11 of the housing 10 according to the present preferred embodiment includes slit groups 130 each of which is arranged in a separate one of the four flat surface portions (i.e., sides) of the outer circumferential surface 11*f* thereof. Each of the slit groups 130 includes a plurality of slits 130*a* to 130*j*. The slits 130*a* to 130*j* in each slit group 130 are arranged in a circumferential direction of the straight surface 11*c*, which defines the inner circumferential surface of the side wall 11. In addition, the slits 130*a* to 130*j* in each slit group 130 are arranged to extend in the same direction through the side wall 11 from the straight surface 11*c* to the outer circumferential surface 11*f* thereof. The through direction T of each of the slits 130*a* to 130*j* is inclined with respect to the direction perpendicular or substantially perpendicular to the corresponding flat surface portion (i.e., side) of the side wall 11. More specifically, the through direction T is inclined to such a direction that the through direction T becomes closer to the direction in which the impeller 20 draws in air (i.e., the rotation direction R of the impeller 20). The slits 130*a* to 130*j* inclined in the above-described manner will be herein referred to as "inclined slits".

Figure 10:
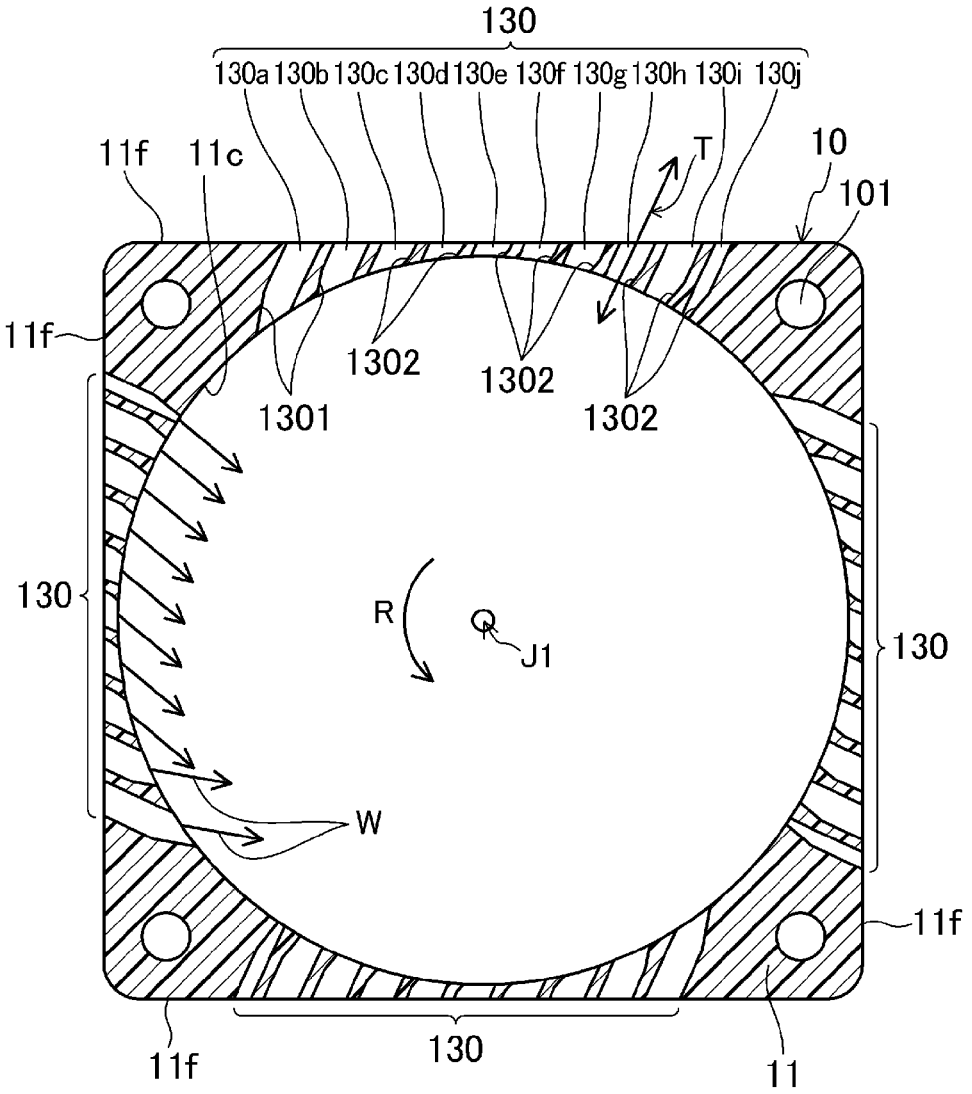
FIG. 10 is a cross-sectional view of the housing according to the third preferred embodiment of the present invention in a cross-section perpendicular to the central axis J1.

In addition, referring to FIG. 10, a tapered wind guide portion 1301 or 1302 is defined in an end portion of each of the slits 130*a* to 130*j* on a side closer to the central axis J1 (i.e., on a side closer to the straight surface 11*c*). More specifically, regarding each slit group 130, each of the slit 130*a*, which is positioned most forward with respect to the rotation direction R of the impeller 20, and the slit 130*b*, which is adjacent to the slit 130*a*, is provided with the wind guide portion 1301. The wind guide portion 1301 is defined in a forward portion (i.e., a forward wall) of each of the slits 130*a* and 130*b* with respect to the rotation direction R of the impeller 20. The wind guide portion 1301 has a tapered shape and is arranged to be angled rearward with respect to the rotation direction R of the impeller 20 with decreasing distance from an end thereof on the side closer to the central axis J1 (i.e., an end thereof on the side closer to the straight surface 11*c*). That is, the wind guide portion 1301 is arranged to guide an air passing through the slit 130*a* or 130*b* rearward (with respect to the rotation direction R of the impeller 20) relative to the through direction T of the slit 130*a* or 130*b*. Meanwhile, regarding each slit group 130, each of the slit 130*j*, which is positioned most rearward with respect to the rotation direction R of the impeller 20, and the remaining slits 130*c* to 130*i* is provided with the wind guide portion 1302. The wind guide portion 1302 is defined in a rearward portion (i.e., a rearward wall) of each of the slits 130*c* to 130*j* with respect to the rotation direction R of the impeller 20. The wind guide portion 1302 has a tapered shape and is arranged to be angled forward with respect to the rotation direction R of the impeller 20 with decreasing distance from an end thereof on the side closer to the central axis J1 (i.e., an end thereof on the side closer to the straight surface 11*c*). That is, the wind guide portions 1302 are arranged to guide air passing through the slits 130*c* to 130*j* forward (with respect to the rotation direction R of the impeller 20) relative to the through direction T of each of the slits 130*c* to 130*j*.

In each of the slits 130*a* and 130*b*, the wind guide portion 1301 serves to shift the air intake direction W from the through direction T of the slit rearward with respect to the rotation direction R. As a result, the air intake direction W of each of the slits 130*a* and 130*b* is angled to approach the direction in which the impeller 20 draws in air (in other words, the rotation direction R of the impeller 20). In the case of a group of inclined slits, air intake directions of the slits on the whole tend to be angled towards the direction in which the impeller 20 draws in air. However, the air intake direction of the slit that is positioned most forward with respect to the rotation direction of the impeller, in particular, tends to conversely deviate forward (with respect to the rotation direction) from the direction in which the impeller draws in air. In the present preferred embodiment, however, the provision of the wind guide portions 1301 contributes to shifting the air intake direction W of each of the slits 130*a* and 130*b* rearward with respect to the rotation direction R of the impeller 20 so that the air intake direction W securely becomes closer to the direction in which the impeller 20 draws in air. As a result, an improvement in the air intake efficiency and a reduction in noise are achieved.

Meanwhile, in each of the slits 130*c* to 130*j*, the wind guide portion 1302 serves to shift the air intake direction W from the through direction T of the slit forward with respect to the rotation direction R. As a result, the air intake direction W of each of the slits 130*c* to 130*j* approaches the direction in which the impeller 20 draws in air (in other words, the rotation direction R of the impeller 20). Even in the case of the inclined slits, the air intake directions of slits that are positioned rearward with respect to the rotation direction of the impeller (especially, the air intake direction of the slit that is positioned most rearward) tend to be insufficiently close to the direction in which the impeller draws in air, and tend to considerably deviate rearward (with respect to the rotation direction) from the direction in which the impeller draws in air. In the present preferred embodiment, however, the provision of the wind guide portions 1302 contributes to shifting the air intake direction W of each of the slits 130*c* to 130*j* forward with respect to the rotation direction R of the impeller 20 so that the air intake direction W approaches the direction in which the impeller 20 draws in air. As a result, an improvement in the air intake efficiency and a reduction in noise are achieved.

In the present preferred embodiment, a division is made between the slits 130*b* and 130*c*. That is, the slits 130*a* to 130*j* are divided into a group including the slits 130*a* and 130*b*, in each of which the wind guide portion 1301 is defined in the forward portion with respect to the rotation direction R, and a group including the slits 130*c* to 130*j*, in each of which the wind guide portion 1302 is defined in the rearward portion with respect to the rotation direction R. Note, however, that this is not essential to the present invention. The above division may be made between any adjacent slits in other preferred embodiments of the present invention, as long as the wind guide portion 1301 is defined in the forward portion (with respect to the rotation direction R) of the slit 130*a*, which is positioned most forward with respect to the rotation direction R, and the wind guide portion 1302 is defined in the rearward portion (with respect to the rotation direction R) of the slit 130*j*, which is positioned most rearward with respect to the rotation direction R. In other words, considering an angle of inclination of the through direction T of each of the slits 130*a* to 130*j* and the direction in which the impeller 20 draws in air, the locations of the wind guide portions 1301 and 1302 can be variously determined so that the air intake direction W may approach to the direction in which the impeller 20 draws in air.

Also note that, within each slit group 130, the wind guide portions 1301 and 1302 may be defined in only the slit 130*a*, which is positioned most forward with respect to the rotation direction R of the impeller 20, and the slit 130*j*, which is positioned most rearward with respect to the rotation direction R of the impeller 20, respectively, in a modification of the present preferred embodiment. Also note that, within each slit group 130, only the wind guide portion 1301 may be defined in the slit 130*a*, which is positioned most forward with respect to the rotation direction R of the impeller 20, in a modification of the present preferred embodiment. Also note that, within each slit group 130, only the wind guide portion 1302 may be defined in the slit 130*j*, which is positioned most rearward with respect to the rotation direction R of the impeller 20, in a modification of the present preferred embodiment. Also note that, in a modification of the present preferred embodiment, neither the slit 130*a*, which is positioned most forward with respect to the rotation direction R, nor the slit 130*j*, which is positioned most rearward with respect to the rotation direction R, may be provided with a wind guide portion, as long as at least one of the slits 130*b* to 130*i*, which are intermediate between the slits 130*a* and 130*j*, which are positioned most forward and most rearward, respectively, with respect to the rotation direction R is provided with a wind guide portion, and the aforementioned beneficial effects are thereby achieved, considering the angle of inclination of the through direction T of each of the slits 130*a* to 130*j* and the direction in which the impeller 20 draws in air.

Figure 11:
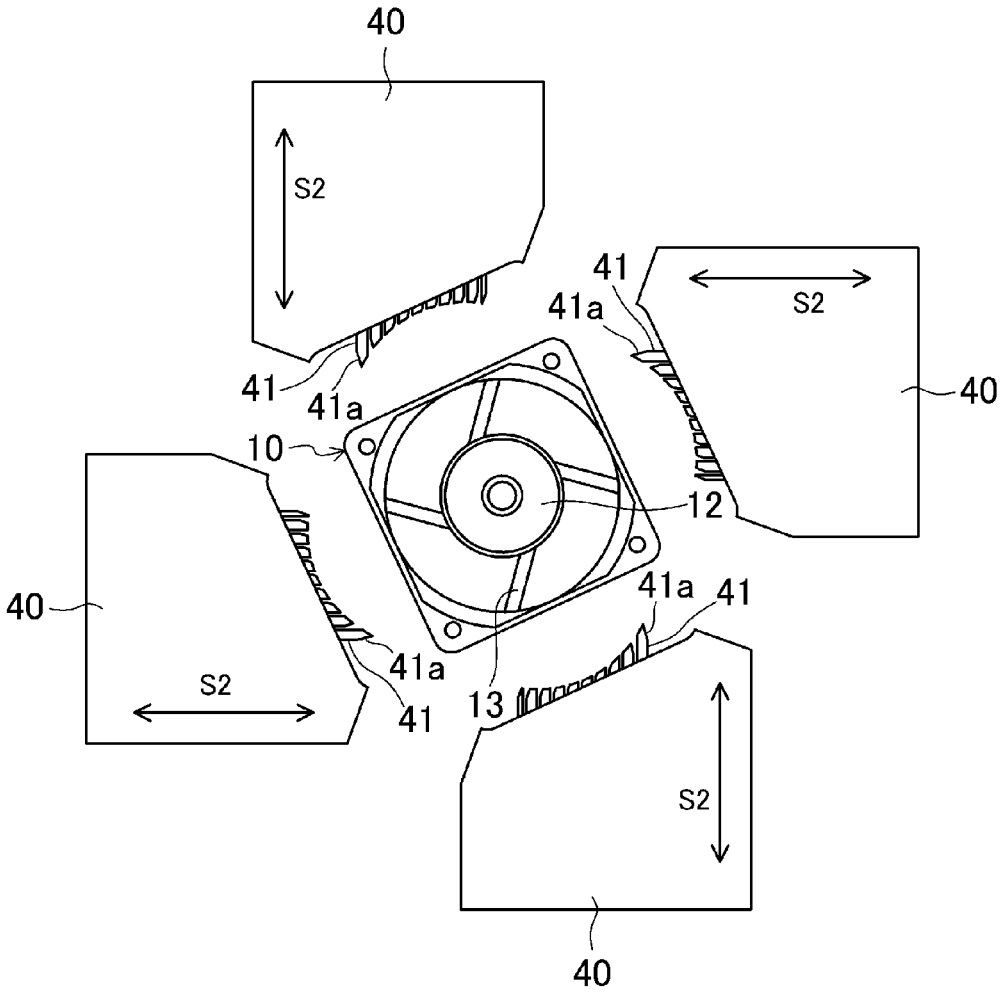
FIG. 11 is a plan view illustrating an example of slide molds that can be used to mold the housing according to the third preferred embodiment of the present invention.

Referring to FIG. 11, each of slide molds 40 is caused to slide in a direction (i.e., in a slide direction S2) parallel or substantially parallel to the through direction T of each of the slits 130*a* to 130*j* to achieve mold release, so that the slits 130*a* to 130*j* and the outer circumferential surface 11*f* of the side wall 11 according to the present preferred embodiment are resin-molded. Each of the slide molds 40 includes slit defining portions 41 corresponding to the slits 130*a* to 130*j*. Each of the slit defining portions 41 includes a tapered cut portion 41*a* arranged to define the wind guide portion 1301 or 1302 defined at a top thereof. Thus, the wind guide portions 1301 and 1302 are easily defined in the slits 130*a* to 130*j* by simply causing each of the slide molds 40 to slide in the direction parallel or substantially parallel to the through direction T of each of the slits 130*a* to 130*j*.

If each of the slit defining portions 41 corresponding to the slits 130*a* and 130*b* (i.e., out of the slits 130*a* to 130*j*, the slits in which the wind guide portion 1301 is defined in the forward portion with respect to the rotation direction R) did not include the cut portion 41*a* defined at the top thereof, the top thereof would have a sharp shape, leading to an increased probability of damage to the slit defining portion 41. Because each of the slit defining portions 41 corresponding to the slits 130*a* and 130*b* includes the cut portion 41*a* defined at the top thereof in the present preferred embodiment, the tops of the slit defining portions 41 are prevented from having a sharp shape. This leads to a reduced probability of damage to the slit defining portions 41, and to an extended life of the slide mold 40.

Moreover, the provision of the cut portions 41*a* at the tops of the slit defining portions 41 contributes to reducing friction that is caused between the resin and the slide mold 40 when the slide mold 40 is caused to slide away from the housing 10 to achieve mold release (as compared to when each slit defining portion of the slide mold has a sharp shape). The reduced friction makes it easier to accomplish the mold release of the slide molds 40.

Fourth Preferred Embodiment

A fourth preferred embodiment of the present invention will now be described below with reference to FIG. 12. An axial fan according to the present preferred embodiment is similar to the axial fan A according to the first preferred embodiment described above except in the structure of slits.

As with the side wall 11 of the housing 10 according to the first preferred embodiment described above, the side wall 11 of the housing 10 according to the present preferred embodiment includes slit groups 140 each of which is arranged in a separate one of the four flat surface portions (i.e., sides) of the outer circumferential surface 11*f* thereof. Each of the slit groups 140 includes a plurality of slits 140*a* to 140*k*. The slits 140*a* to 140*k* in each slit group 140 are arranged in a circumferential direction of the straight surface 11*c*, which defines the inner circumferential surface of the side wall 11. In addition, the slits 140*a* to 140*k* in each slit group 140 are arranged to extend in the same direction through the side wall 11 from the straight surface 11*c* to the outer circumferential surface 11*f* thereof. The through direction T of each of the slits 140*a* to 140*k* is arranged to extend in a direction perpendicular or substantially perpendicular to the corresponding flat surface portion (i.e., side) of the side wall 11, as with the through direction T of each of the slits 110*a* to 110*h* according to the first preferred embodiment described above. The slits 140*a* to 140*k*, the through direction T of which is arranged to extend in a direction perpendicular or substantially perpendicular to the corresponding flat surface portion (i.e., side), will be herein referred to as "straight slits".

Figure 12:
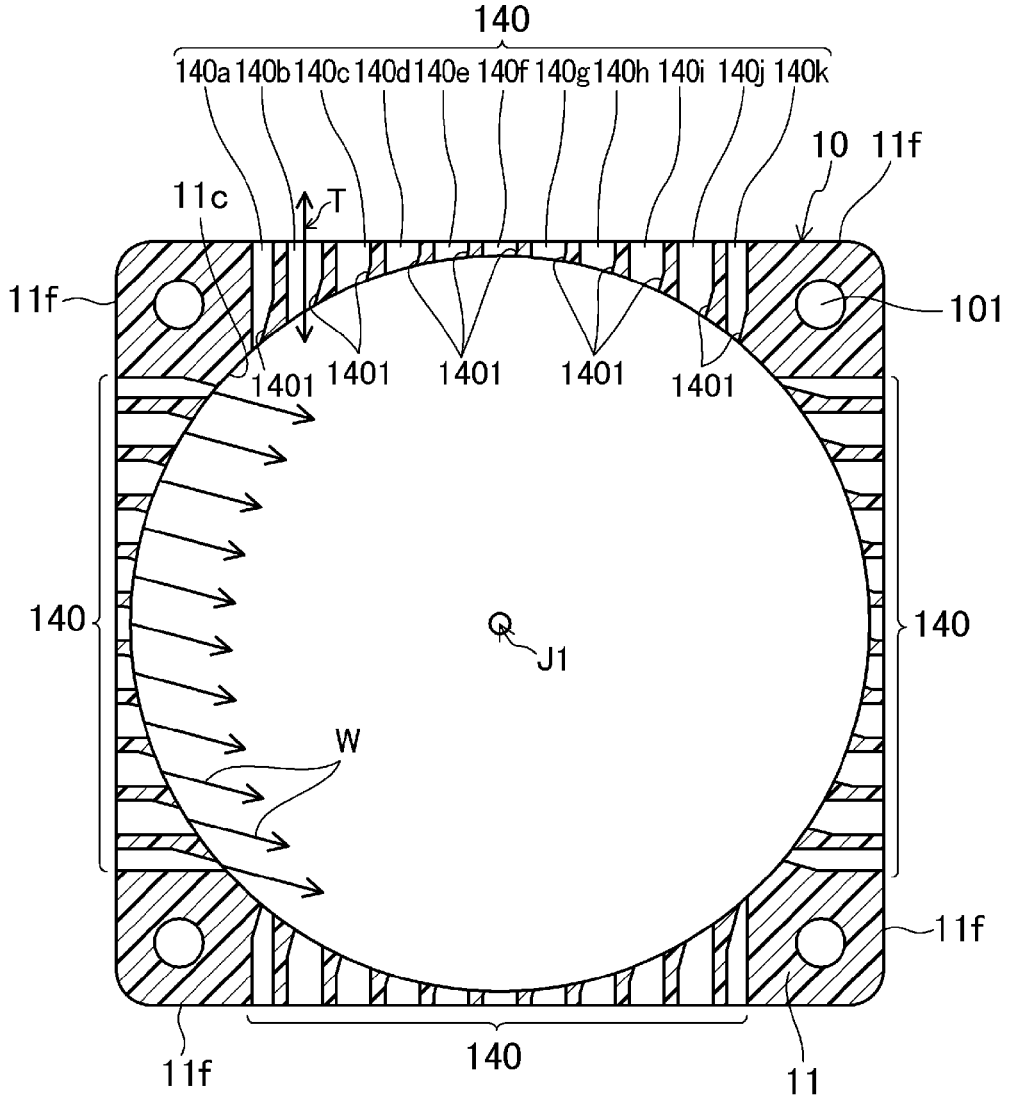
FIG. 12 is a cross-sectional view of a housing according to a fourth preferred embodiment of the present invention in a cross-section perpendicular to the central axis J1.

In addition, referring to FIG. 12, a tapered wind guide portion 1401 is defined in an end portion of each of the slits 140*a* to 140*k* on a side closer to the central axis J1 (i.e., on a side closer to the straight surface 11*c*). More specifically, each of the slits 140*a* to 140*k* in each slit group 140 includes the wind guide portion 1401 defined in a rearward portion (i.e., a rearward wall) thereof with respect to the rotation direction R of the impeller 20. The wind guide portion 1401 has a tapered shape and is arranged to angle forward with respect to the rotation direction R of the impeller 20 with decreasing distance from an end thereof on the side closer to the central axis J1 (i.e., an end thereof on the side closer to the straight surface 11*c*). That is, the wind guide portions 1401 are arranged to guide air passing through the slits 140*a* to 140*k* forward (with respect to the rotation direction R of the impeller 20) relative to the through direction T of each of the slits 140*a* to 140*k*.

In each of the slits 140*a* to 140*k*, the wind guide portion 1401 serves to shift the air intake direction W from the through direction T of the slit forward with respect to the rotation direction R. As a result, the air intake direction W of each of the slits 140*a* to 140*k* approaches the direction in which the impeller 20 draws in air (in other words, the rotation direction R of the impeller 20). In the case of the straight slits, air intake directions of slits that are positioned rearward with respect to the rotation direction of the impeller (especially, the air intake direction of the slit that is positioned most rearward) tend to differ considerably from the direction in which the impeller draws in air. Moreover, even in the case of the straight slits, air intake directions of slits that are positioned forward with respect to the rotation direction of the impeller may not be sufficiently close to the direction in which the impeller draws in air. Even in that case, the provision of the wind guide portions 1401 according to the present preferred embodiment serves to shift the air intake direction W of each of the slits 140*a* to 140*k* forward with respect to the rotation direction R of the impeller 20 so that the air intake direction W approaches the direction in which the impeller 20 draws in air. As a result, an improvement in the air intake efficiency and a reduction in noise are achieved.

In the present preferred embodiment, all of the slits 140*a* to 140*k* in each slit group 140 are provided with the wind guide portions 1401. Note, however, that this is not essential to the present invention. For example, only the slit 140*k*, which is positioned most rearward with respect to the rotation direction R of the impeller 20, may be provided with the wind guide portion 1401, or only a predetermined number of slits that are positioned most rearward (including the slit 140*k*, which is positioned most rearward) may be provided with the wind guide portions 1401, in other preferred embodiments of the present invention. Also, only the slit 140*a*, which is positioned most forward with respect to the rotation direction R of the impeller 20, may be provided with the wind guide portion 1401, or only a predetermined number of slits that are positioned most forward (including the slit 140*a*, which is positioned most forward) may be provided with the wind guide portions 1401, in other preferred embodiments of the present invention. Also note that, in a modification of the present preferred embodiment, neither the slit 140*a*, which is positioned most forward with respect to the rotation direction R, nor the slit 140*k*, which is positioned most rearward with respect to the rotation direction R, may be provided with a wind guide portion, as long as at least one of the slits 140*b* to 140*j*, which are intermediate between the slits 140*a* and 140*k*, which are positioned most forward and most rearward, respectively, with respect to the rotation direction R is provided with a wind guide portion, and the aforementioned beneficial effects are thereby achieved, considering the angle of inclination of the through direction T of each of the slits 140*a* to 140*k* and the direction in which the impeller 20 draws in air.

Although not shown in the figures, in the present preferred embodiment as well as in the third preferred embodiment described above, slide molds each of which includes slit defining portions each with a cut portion corresponding to the wind guide portion 1401 defined at a top thereof are used to resin-mold the slits 140*a* to 140*k* and the outer circumferential surface 11*f*. As in the third preferred embodiment described above, the provision of the cut portion at the top of each slit defining portion contributes to reducing friction that is caused between the resin and the slide mold when the slide mold is caused to slide away from the housing 10 to achieve mold release (as compared to when each slit defining portion of the slide mold has a sharp shape). The reduced friction makes it easier to accomplish the mold release of the slide molds.

Fifth Preferred Embodiment

Figure 13:
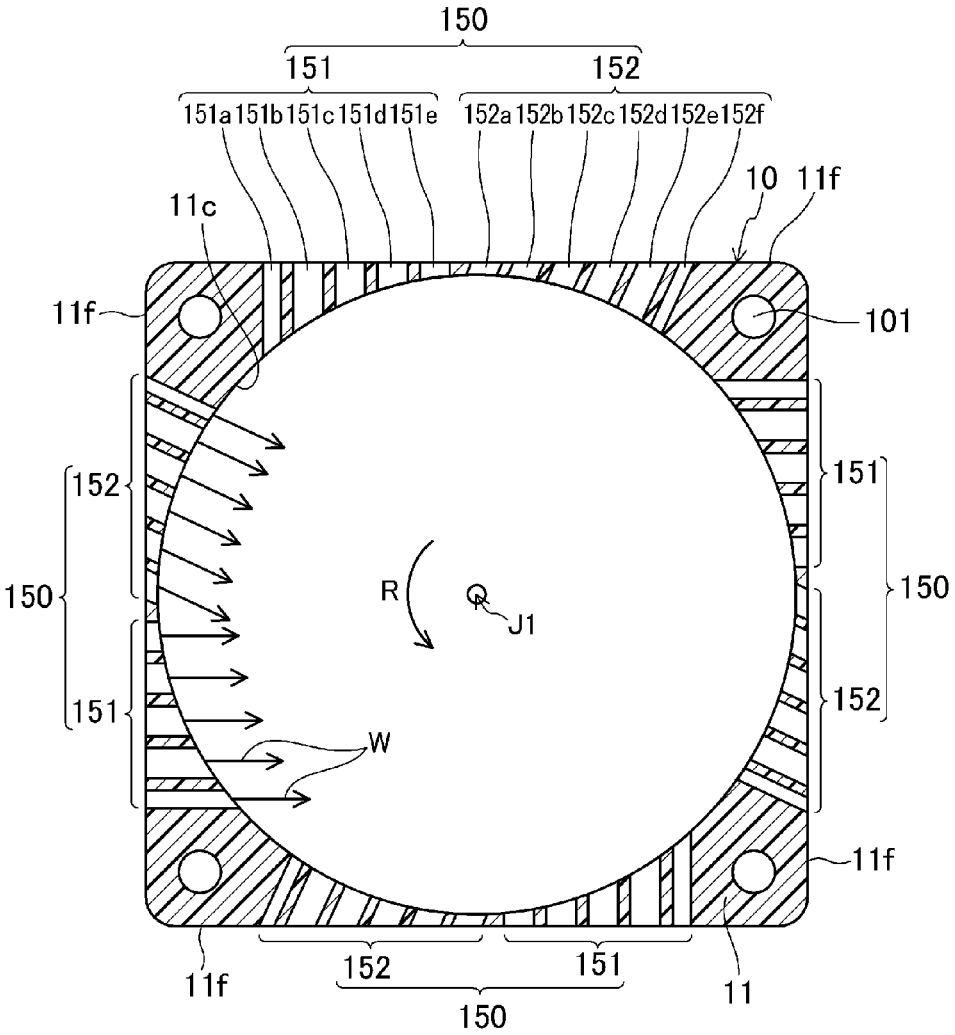
FIG. 13 is a cross-sectional view of a housing according to a fifth preferred embodiment of the present invention in a cross-section perpendicular to the central axis J1.

A fifth preferred embodiment of the present invention will now be described below with reference to FIGS. 13 and 14. An axial fan A according to the present preferred embodiment is similar to the axial fan A according to the first preferred embodiment described above except in the structure of slits.

As with the side wall 11 of the housing 10 according to the first preferred embodiment described above, the side wall 11 of the housing 10 according to the present preferred embodiment includes slit groups 150 each of which is arranged in a separate one of the four flat surface portions (i.e., sides) of the outer circumferential surface 11*f* thereof. Each of the slit groups 150 includes a plurality of slits 151*a* to 151*e* and 152*a* to 152*f*. The slits 151*a* to 151*e* and 152*a* to 152*f* in each slit group 150 are arranged in a circumferential direction of the straight surface 11*c*, which defines the inner circumferential surface of the side wall 11. In addition, each of the slits 151*a* to 151*e* and 152*a* to 152*f* is arranged to extend through the side wall 11 from the straight surface 11*c* to the outer circumferential surface 11*f* (i.e., the corresponding side) thereof.

Each of the slits 151*a* to 151*e* and 152*a* to 152*f* in each slit group 150 has one of two different through directions T. In other words, each slit group 150 includes the slits 151*a* to 151*e* and 152*a* to 152*f* which have two different through directions T. More specifically, each slit group 150 is divided into a forward slit group 151 and a rearward slit group 152. The forward slit group 151 includes the slits 151*a* to 151*e*, which are arranged forward with respect to the rotation direction R of the impeller 20, and the through directions T of which are parallel or substantially parallel to each other. The rearward slit group 152 includes the slits 152*a* to 152*f*, which are arranged rearward of the forward slit group 151 with respect to the rotation direction R of the impeller 20, and the through directions T of which are parallel or substantially parallel to each other.

The through direction T of each of the slits 151*a* to 151*e* in the forward slit group 151 is perpendicular or substantially perpendicular to the corresponding flat surface portion (i.e., side) of the side wall 11, as with the through direction T of each of the slits 110*a* to 110*h* according to the first preferred embodiment described above. The through direction T of each of the slits 152*a* to 152*f* in the rearward slit group 152 is arranged to incline with respect to the direction perpendicular or substantially perpendicular to the corresponding flat surface portion (i.e., side) of the side wall 11. More specifically, in the present preferred embodiment, the through direction T of each of the slits 152*a* to 152*f* in the rearward slit group 152 is inclined with respect to the through direction T of each of the slits 151*a* to 151*e* in the forward slit group 151 to such a direction that each of the slits 152*a* to 152*f* becomes more distant from the forward slit group 151 as it extends from the straight surface 11*c*, which defines the inner circumferential surface of the side wall 11, to the outer circumferential surface 11*f*.

According to the present preferred embodiment, regarding each slit group 150, the air intake direction W of each of the slits 152*a* to 152*f* in the rearward slit group 152 is preferably closer to the direction in which the impeller 20 draws in air. This contributes to an improvement in the air intake efficiency and a reduction in noise. That is, according to the present preferred embodiment, regarding each slit group 150, the slits that are positioned rearward with respect to the rotation direction R, the air intake direction W of each of which tends to considerably differ from the direction in which the impeller 20 draws in air, are arranged to be angled so that the air intake efficiency is effectively improved.

Note that, in a modification of the present preferred embodiment, within each slit group 150, only the slit 152*f*, which is positioned most rearward with respect to the rotation direction R of the impeller 20, may be arranged to incline with respect to the direction perpendicular or substantially perpendicular to the corresponding flat surface portion (i.e., side) of the side wall 11, as with each slit in the rearward slit group 152 in the present preferred embodiment. Also note that, in a modification of the present preferred embodiment, within each slit group 150, only one or more of the slits 151*a* to 151*e* and 152*a* to 152*e*, excluding the slit 152*f*, may be arranged to incline with respect to the direction perpendicular or substantially perpendicular to the corresponding flat surface portion (i.e., side) of the side wall 11, as with each slit in the rearward slit group 152 in the present preferred embodiment. That is, an improvement in the air intake efficiency can be achieved when the through direction T of at least one slit in the slit group 150 is arranged to be angled such that the at least one slit in the slit group 150 will approach the direction in which the impeller draws in air as compared to the through direction T of any other slit. Also note that, in a modification of the present preferred embodiment, the through direction T of each slit in the forward slit group 151 may not necessarily be perpendicular or substantially perpendicular to the corresponding flat surface portion (i.e., side) of the side wall 11. Also note that, in a modification of the present preferred embodiment, a slit having a different through direction T from that of the slits in the forward slit group 151 and that of the slits in the rearward slit group 152 may be additionally defined in the side wall 11 of the housing 10. In the present preferred embodiment and modifications thereof, slits having two or more different through directions T are defined in each flat surface portion (i.e., side) of the side wall 11 to effectively achieve an improvement in the air intake efficiency.

Figure 14:
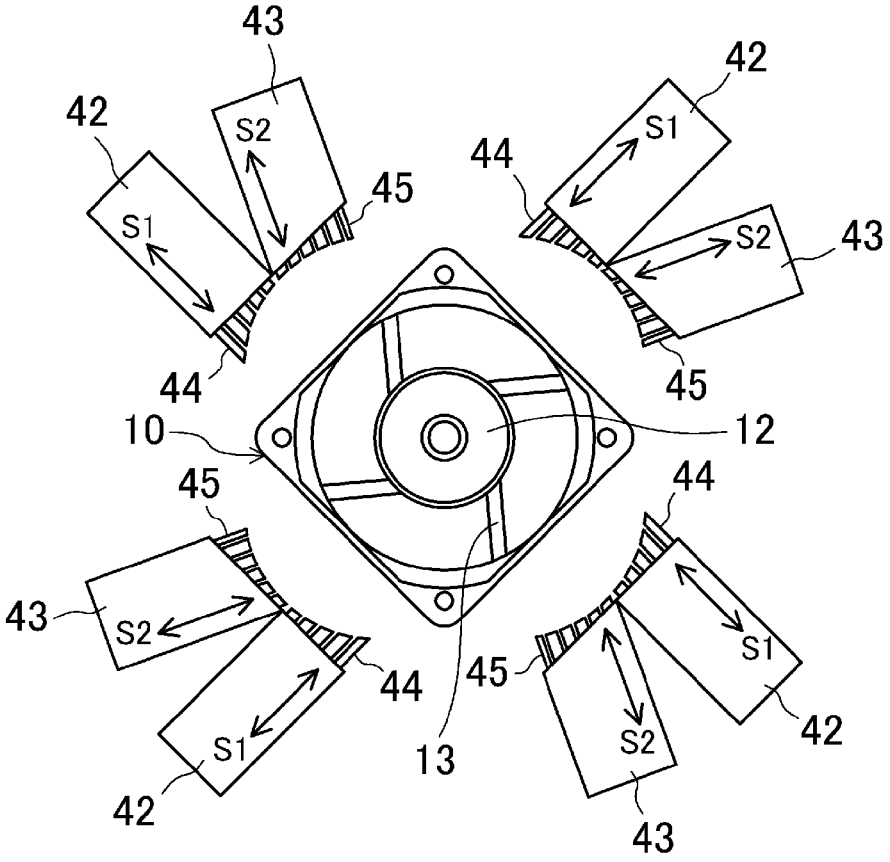
FIG. 14 is a plan view illustrating an example of slide molds that can be used to mold the housing according to the fifth preferred embodiment of the present invention.

Referring to FIG. 14, in the present preferred embodiment, a first slide mold 42, which is used to mold the forward slit group 151 and a portion of the outer circumferential surface 11*f* corresponding to the forward slit group 151, and a second slide mold 43, which is used to mold the rearward slit group 152 and a portion of the outer circumferential surface 11*f* corresponding to the rearward slit group 152, are used in a pair. Specifically, the first slide mold 42 includes slit defining portions 44 corresponding to the slits 151*a* to 151*e* in the forward slit group 151, while the second slide mold 43 includes slit defining portions 45 corresponding to the slits 152*a* to 152*f* in the rearward slit group 152. The first slide mold 42 is caused to slide in a direction (i.e., in a slide direction S1) parallel or substantially parallel to the through direction T of each slit in the forward slit group 151, while the second slide mold 43 is caused to slide in a direction (i.e., in a slide direction S2) parallel or substantially parallel to the through direction T of each slit in the rearward slit group 152. As described above, in the present preferred embodiment, not all the slits but only the slits 152*a* to 152*f* (i.e., the slits in the rearward slit group 152) in each slit group 150 are arranged to be angled, and the second slide mold 43 described above can be reduced in size as compared to when all the slits in each slit group 150 are arranged to incline. This contributes to reducing the material costs for the molds, even though the second slide molds 43 may be relatively vulnerable to damage and may have a shortened life.

Other Preferred Embodiments

Figure 15:
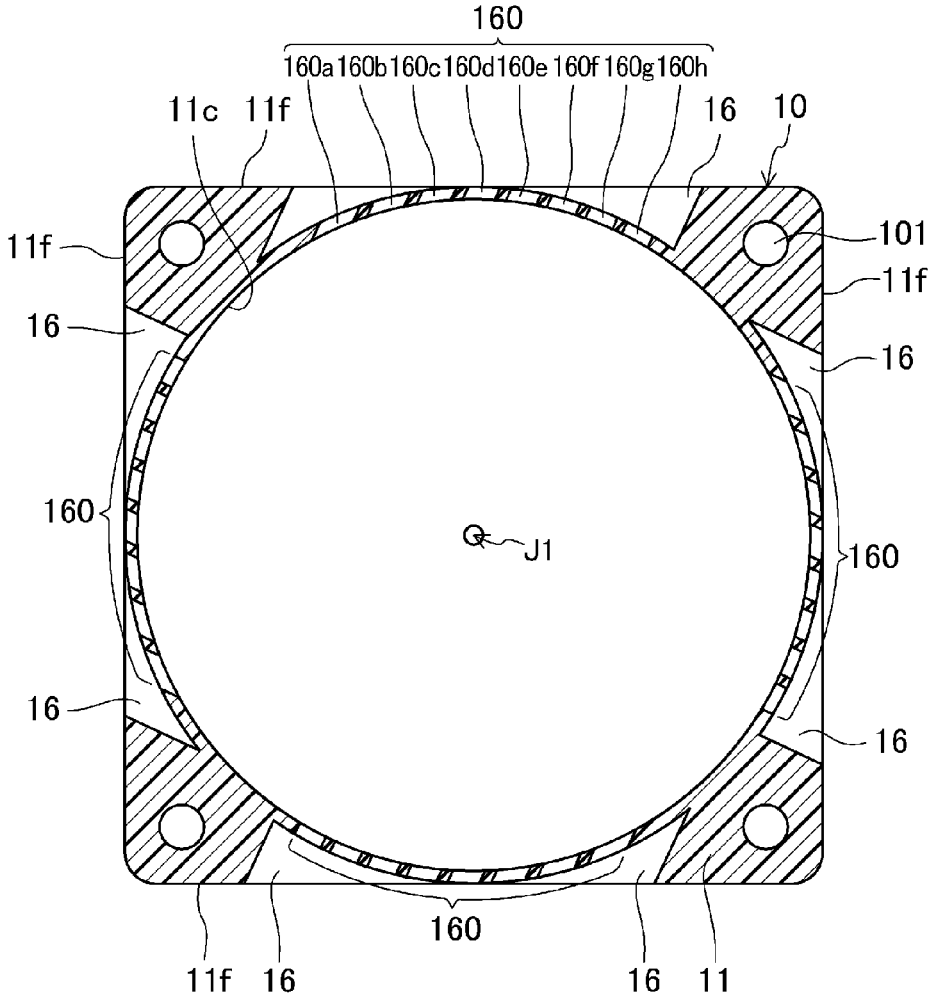
FIG. 15 is a cross-sectional view of a housing according to another preferred embodiment of the present invention in a cross-section perpendicular to the central axis J1.
Figure 16:
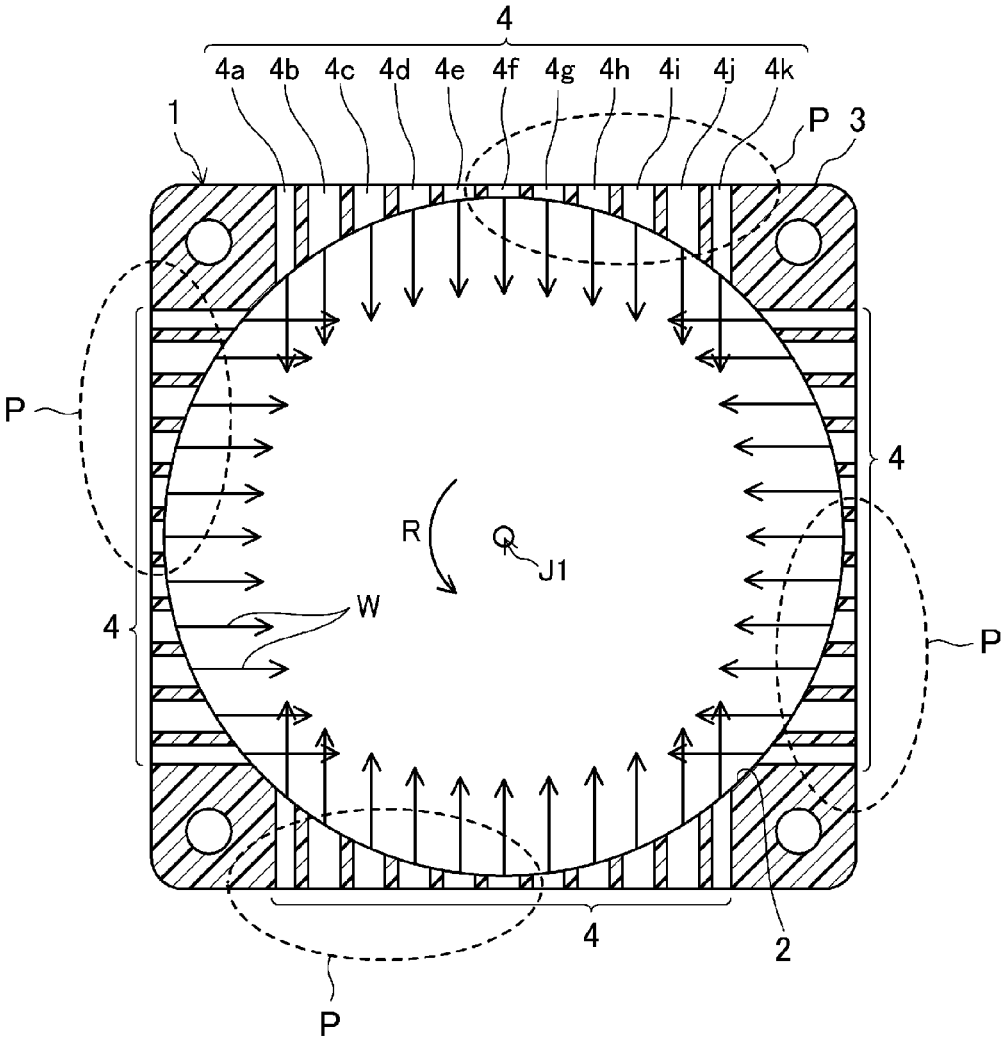
Fig.16 PRIOR ART
FIG. 16 is a cross-sectional view of a conventional housing in a cross-section perpendicular to a central axis J1.

Another preferred embodiment of the present invention will now be described below with reference to FIG. 15. An axial fan according to this preferred embodiment is similar to the axial fan A according to the first preferred embodiment described above except in the structure of the side wall 11 of the housing 10.

The side wall 11 of the housing 10 according to this preferred embodiment includes "reduced wall thickness portions" 16 defined in the outer circumferential surface 11*f* thereof, so that portions of the side wall 11 in which slit groups 160 (each of which includes a plurality of slits 160*a* to 160*h*) are defined have a substantially uniform thickness. That is, a forward end portion and a rearward end portion (with respect to the rotation direction R of the impeller 20) of each portion of the side wall 11 in which the slit group 160 is defined have substantially the same thickness as that of an intermediate portion thereof. Thus, a reduction is achieved in the thickness of each of the forward end portion and the rearward end portion (with respect to the rotation direction R of the impeller 20) of each portion of the side wall 11 in which the slit group 160 is defined. This results in a reduction in the dimension (i.e., stroke) in the through direction T of each of the slits that are positioned most forward and most rearward with respect to the rotation direction R, leading to a reduction in resistance against inflow of air through each of these slits. As a result, an improvement in the air intake efficiency is achieved.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An axial fan comprising:

an impeller arranged to rotate about a central axis and including a plurality of blades centered on the central axis, the plurality of blades being arranged to be spaced apart in a circumferential direction and to project radially outward;

a housing including a side wall arranged to surround an outer circumference of the impeller; and a substantially square or substantially rectangular flange arranged on an axial end of the side wall on an inlet side or an outlet side; wherein the side wall includes a slit group including a plurality of slits arranged to be spaced apart in a circumferential direction of an inner circumferential surface of the side wall, and arranged to extend in the same direction perpendicular or substantially perpendicular to one side of the flange through the side wall from the inner circumferential surface to an outer circumferential surface thereof; and within the slit group, a total number of slits that are positioned forward, with respect to a rotation direction of the impeller, of a point at which a straight line extending from the central axis to one side of the flange and perpendicular to the side wall crosses the slit group is greater than a total number of slits that are positioned rearward of the point with respect to a circumferential rotation direction of the impeller.

2. The axial fan according to claim 1, wherein a longitudinal direction of each of the plurality of slits on the outer circumferential surface of the side wall is parallel or substantially parallel to the central axis or defines an acute angle with a direction parallel to the central axis.

3. An axial fan comprising:

an impeller arranged to rotate about a central axis and including a plurality of blades centered on the central axis, the plurality of blades being arranged to be spaced apart in a circumferential direction and to project radially outward; and a housing including a side wall arranged to surround an outer circumference of the impeller, the side wall including at least one flat surface portion defined in an outer circumferential surface thereof; wherein the side wall includes a slit group including a plurality of slits arranged to be spaced apart in a circumferential direction of an inner circumferential surface of the side wall, and arranged to extend in the same direction perpendicular or substantially perpendicular to the flat surface portion through the side wall from the inner circumferential surface to the outer circumferential surface thereof; and within the slit group, a total number of slits that are positioned forward, with respect to a rotation direction of the impeller, of a point at which a straight line extending from the central axis to one side of the flange and perpendicular to the side wall crosses the slit group is greater than a total number of slits that are positioned rearward of the point with respect to a circumferential rotation direction of the impeller.

4. The axial fan according to claim 3, wherein a longitudinal direction of each of the plurality of slits on the outer circumferential surface of the side wall is parallel or substantially parallel to the central axis or defines an acute angle with a direction parallel to the central axis.

5. An axial fan comprising:

an impeller arranged to rotate about a central axis and including a plurality of blades centered on the central axis, the plurality of blades being arranged to be spaced apart in a circumferential direction and projecting radially outward; and a housing including a side wall arranged to surround an outer circumference of the impeller; wherein the side wall includes a slit group including a plurality of slits arranged to be spaced apart in a circumferential direction of an inner circumferential surface of the side wall, and arranged to extend in the same direction through the side wall from the inner circumferential surface to an outer circumferential surface thereof; and at least one of the plurality of slits in the slit group includes a tapered wind guide portion defined in an end portion thereof on a side closer to the central axis, the tapered wind guide portion being defined in only one circumferential side of the at least one of the plurality of slits, the tapered wind guide portion being arranged to shift a direction of air intake through the at least one of the plurality of slits from a through direction of the slit to approach a rotation direction of the impeller.

6. The axial fan according to claim 5, wherein the side wall includes at least one flat surface portion defined in the outer circumferential surface thereof;

each of the plurality of slits in the slit group is arranged to extend through the side wall at an angle to a direction perpendicular or substantially perpendicular to the flat surface portion such that each of the plurality of slits is arranged to extend rearward with respect to the rotation direction of the impeller with decreasing distance from the outer circumferential surface of the side wall; and the at least one of the plurality of slits includes one or more slits within the slit group that are positioned most forward with respect to the rotation direction of the impeller, and the tapered wind guide portion is defined in a forward portion, with respect to the rotation direction of the impeller, of the end portion of each of the one or more slits positioned most forward, such that the tapered wind guide portion is angled rearward with respect to the rotation direction of the impeller with decreasing distance from an end thereof on the side closer to the central axis.

7. The axial fan according to claim 5, wherein the side wall includes at least one flat surface portion defined in the outer circumferential surface thereof;

each of the plurality of slits in the slit group is arranged to extend through the side wall in a direction perpendicular or substantially perpendicular to the flat surface portion; and the at least one of the plurality of slits includes one or more slits within the slit group that are positioned most forward with respect to the rotation direction of the impeller, and the tapered wind guide portion is defined in a rearward portion of the end portion of each of the one or more slits positioned most forward with respect to the rotation direction of the impeller, such that the tapered wind guide portion is angled forward with respect to the rotation direction of the impeller with decreasing distance from an end thereof on the side closer to the central axis.

8. The axial fan according to claim 5, wherein the at least one of the plurality of slits includes one or more slits within the slit group that are positioned most rearward with respect to the rotation direction of the impeller, and the tapered wind guide portion is defined in a rearward portion, with respect to the rotation direction of the impeller, of the end portion of each of the one or more slits positioned most rearward, such that the tapered wind guide portion is angled forward with respect to the rotation direction of the impeller with decreasing distance from an end thereof on the side closer to the central axis.

9. The axial fan according to claim 6, wherein the at least one of the plurality of slits further includes one or more slits within the slit group that are positioned most rearward with respect to the rotation direction of the impeller, and the tapered wind guide portion is defined in a rearward portion of the end portion of each of the one or more slits positioned most rearward with respect to the rotation direction of the impeller, such that the tapered wind guide portion is angled forward with respect to the rotation direction of the impeller with decreasing distance from an end thereof on the side closer to the central axis.

10. The axial fan according to claim 7, wherein the at least one of the plurality of slits further includes one or more slits within the slit group that are positioned most rearward with respect to the rotation direction of the impeller, and the tapered wind guide portion is defined in a rearward portion, with respect to the rotation direction of the impeller, of the end portion of each of the one or more slits positioned most rearward, such that the tapered wind guide portion is angled forward with respect to the rotation direction of the impeller with decreasing distance from an end thereof on the side closer to the central axis.

11. The axial fan according to claim 5, wherein the at least one of the plurality of slits includes one or more slits within the slit group that are intermediate between the slit positioned most forward and the slit positioned most rearward with respect to the rotation direction of the impeller, and the tapered wind guide portion is defined in a forward portion, with respect to the rotation direction of the impeller, of the end portion of each of the one or more intermediate slits, such that the tapered wind guide portion is angled rearward with respect to the rotation direction of the impeller with decreasing distance from an end thereof on the side closer to the central axis.

12. The axial fan according to claim 5, wherein the at least one of the plurality of slits includes one or more slits within the slit group that are intermediate between the slit positioned most forward and the slit positioned most rearward with respect to the rotation direction of the impeller, and the tapered wind guide portion is defined in a rearward portion, with respect to the rotation direction of the impeller, of the end portion of each of the one or more intermediate slits, such that the tapered wind guide portion is angled forward with respect to the rotation direction of the impeller with decreasing distance from an end thereof on the side closer to the central axis.

13. The axial fan according to claim 5, wherein a longitudinal direction of each of the plurality of slits on the outer circumferential surface of the side wall is parallel or substantially parallel to the central axis or defines an acute angle with a direction parallel to the central axis.

14. An axial fan comprising:

an impeller arranged to rotate about a central axis and including a plurality of blades, the plurality of blades being arranged to be spaced apart in a circumferential direction and to project radially outward; and a housing including a side wall arranged to surround an outer circumference of the impeller, the side wall including at least one flat surface portion defined in an outer circumferential surface thereof; wherein the side wall includes a slit group including a plurality of slits arranged to be spaced apart in a circumferential direction of an inner circumferential surface of the side wall, and arranged to extend through the side wall from the inner circumferential surface to the at least one flat surface portion thereof;

the plurality of slits in the at least one flat surface portion include two or more different slits which have through directions that are different from one another;

the plurality of slits in the slit group are divided into a forward slit group and a rearward slit group, the forward slit group including slits that are positioned forward with respect to a rotation direction of the impeller, and through directions of which are parallel or substantially parallel to each other, the rearward slit group including slits that are positioned rearward with respect to the rotation direction of the impeller, and through directions of which are parallel or substantially parallel to each other; and the through direction of each of the slits in the rearward slit group is angled with respect to the through direction of each of the slits in the forward slit group to such a direction that each of the slits in the rearward slit group becomes more distant from the forward slit group as it extends from the inner circumferential surface to the outer circumferential surface.

15. The axial fan according to claim 14, wherein a longitudinal direction of each of the plurality of slits on the outer circumferential surface of the side wall is parallel or substantially parallel to the central axis or defines an acute angle with a direction parallel to the central axis.

16. The axial fan according to claim 14, wherein the through directions that are different from one another intersect with one another at a position radially inward of the side wall and radially outward of the central axis.

* * * * *